US005670997A

United States Patent [19]

Sugimoto et al.

[11] Patent Number: 5,670,997

[45] Date of Patent: Sep. 23, 1997

[54] RECORDING MEANS FOR ENHANCING REMOVAL OF INK DEPOSITED ON AN EJECTION SIDE SURFACE THEREOF, INK JET RECORDING APPARATUS HAVING SAID RECORDING MEANS, AND RECOVERY METHOD

[75] Inventors: Hitoshi Sugimoto, Kawasaki; Hiromitsu Hirabayashi, Yokohama; Shigeyasu Nagoshi, Kawasaki; Noribumi Koitabashi, Yokohama; Miyuki Matsubara, Tokyo; Fumihiro Gotoh, Yokohama; Masaya Uetsuki, Kawasaki, all of Japan

[73] Assignee: Canon Kabushiki Kaisha, Tokyo, Japan

[21] Appl. No.: 94,688

[22] Filed: Jul. 21, 1993

[30] Foreign Application Priority Data

Jul. 24, 1992 [JP] Japan ..... 4-218368

[51] Int. Cl.[6] ..... B41J 2/165

[52] U.S. Cl. ..... 347/30

[58] Field of Search ..... 347/29, 30, 31, 347/32, 33, 22, 90

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,510,510 | 4/1985 | Terasawa | 347/30 |
| 4,558,333 | 12/1985 | Sugitani et al. | 347/65 |
| 4,567,494 | 1/1986 | Taylor | 347/32 |
| 4,591,873 | 5/1986 | McCann et al. | 347/25 |
| 4,631,556 | 12/1986 | Watanabe et al. | 347/30 |
| 4,712,172 | 12/1987 | Kiyohara et al. | 347/87 X |
| 4,723,129 | 2/1988 | Endo et al. | 347/56 |
| 4,739,340 | 4/1988 | Terasawa | 347/30 |
| 4,740,796 | 4/1988 | Endo et al. | 347/56 |
| 4,745,414 | 5/1988 | Okamura et al. | 347/30 |
| 4,772,900 | 9/1988 | Nagoshi | 347/7 |
| 4,965,596 | 10/1990 | Nagoshi et al. | 347/36 |
| 4,967,204 | 10/1990 | Terasawa et al. | 347/23 |
| 4,999,643 | 3/1991 | Terasawa | 347/30 |
| 5,055,856 | 10/1991 | Tommii et al. | 347/30 |
| 5,216,450 | 6/1993 | Koitabashi et al. | 347/87 |

FOREIGN PATENT DOCUMENTS

| | | | |
|---|---|---|---|
| 0259193 | 3/1986 | European Pat. Off. . | |
| 0273362 | 7/1988 | European Pat. Off. . | |
| 0286841 | 10/1988 | European Pat. Off. . | |
| 0317267 | 5/1989 | European Pat. Off. . | |
| 0362897 | 4/1990 | European Pat. Off. . | |
| 0442440 | 8/1991 | European Pat. Off. . | |
| 57-027757 | 2/1982 | Japan . | |
| 60-023048 | 2/1985 | Japan . | |
| 60-122160 | 6/1985 | Japan . | |
| 60-151060 | 8/1985 | Japan . | |
| 60-151059 | 8/1985 | Japan . | |
| 63-252748 | 10/1988 | Japan | 347/23 |
| 3-253348 | 11/1991 | Japan . | |
| 4-65250 | 3/1992 | Japan | 347/30 |

*Primary Examiner*—John E. Barlow, Jr.

*Attorney, Agent, or Firm*—Fitzpatrick, Cella, Harper & Scinto

[57] ABSTRACT

An ink jet recording apparatus includes a carriage for carrying a recording head for effecting recording by ejection of ink on a recording material; a cap for capping an ejection outlet of the recording head formed in an ejection side surface; sucking pump for sucking the ink out through the ejection outlet while the cap is closely contacted to the ejection side surface; a clearance forming mechanism for forming a clearance at a part of close-contact portion between the ejection side surface and the cap by relative motion between the cap and the carriage.

23 Claims, 20 Drawing Sheets

RECORDING MEANS FOR ENHANCING REMOVAL OF INK DEPOSITED ON AN EJECTION SIDE SURFACE THEREOF, INK JET RECORDING APPARATUS HAVING SAID RECORDING MEANS, AND RECOVERY METHOD

FIELD OF THE INVENTION AND RELATED ART

The present invention relates to a recording means for ejecting ink onto a recording material to effect recording, an ink jet apparatus, and a recovery means. In particular, it relates to an ink jet recording apparatus comprising a recovery means for recovering the performance of the ink ejection orifice of a recording head, a recording means employed in the apparatus, and recovery method.

A recording apparatus is employed in so many types of office equipment, for example, printers, copying machines, or facsimiles. It is also used as an output means in electronic office equipment such as computers, word processors, or work stations. Such a recording apparatus is designed to record images (including characters) on the recording material (recording medium) such as a sheet of paper, thin plastic film, or the like, based on image data (including character data). They can be classified depending on their recording systems, for example, an ink jet, wire dot, thermal, laser beam, or the like.

In a serial type recording apparatus, the primary scanning is carried out in the direction perpendicular to the direction (secondary scanning direction) in which the recording material is advanced, in other words, a serial scanning system is adopted. After the recording material is set at a predetermined spot, the image is recorded (primary scanning) by the recording means mounted on a carriage which transverses along the recording material. As soon as one lane of recording is completed, the recording material is advanced by a predetermined distance (recording material conveyance), and then, as soon as the recording material stops, the image of next line is recorded (primary scanning). This cycle is repeated until recording is made over the entire surface of the recording material. On the other hand, in a line type recording apparatus, the scanning occurs only on the secondary scanning direction, that is, in the direction in which the recording material is conveyed. In this system, the recording material set at a predetermined spot is continuously advanced (pitch conveyance) while recording is simultaneously made across the entire recording line width, until recording is made over the entire surface of the recording material.

A recording apparatus of an ink jet type (ink jet recording apparatus), which is one of the aforementioned recording apparatuses, records images by ejecting ink from the recording means (recording head) onto the recording material. It offers several advantages: the ability to effect precise recording; no need for specially treated recording material, requiring just ordinary paper, meaning low operating costs; low operating noise because of its non-impact operation; easy size reduction; or the like. There is also such an advantage that it can easily record color images with the use of two or more colors. In particular, the ink jet recording apparatus of the line type can further increase the recording speed, in which a recording means comprises a large number of ejection orifices aligned in the recording material width direction, over the entire recording width, in other words, a full multi-type recording means is employed.

Among the ink jet recording means (recording head), the one which uses thermal energy for ejecting the ink allows a further size reduction. This is because it can be produced through semiconductor manufacturing processes such as etching, vapor deposition, or sputtering, in other word, electrothermal transducers, electrodes, liquid passage walls, top plates, and the like can be easily formed on a substrate, whereby a high density liquid passage arrangement (ejection orifice arrangement) can be easily realized.

On the other hand, there are various demands regarding the properties of the recording material. In recent years, it has become necessary to use extremely thin paper, or fabricated paper product (filing paper with punched holes, paper with perforations, irregularly shaped paper, or the like), in addition to the ordinary recording material such as paper or thin resin film plate (for OHP, or the like).

In the ink jet recording apparatus, the waste ink sometimes adheres to the ejection outlet surface (surface on which the ejection orifices are arranged) of the recording head (recording means), altering the direction in which the ink is ejected, and thereby, deteriorating the picture image quality. To describe in more detail, in the ink jet recording system, when ink droplets are ejected from the recording head to be deposited on the recording material such as paper or OHP film, a mist of floating micro droplets of ink (ink mist) is generated in addition to the main ink droplets, or the ink droplets splash as they land on the recording material. The ejection outlet surface is wetted as this mist or splash of ink adheres. If the adhering ink excessively accumulates in the vicinity of the ejection orifices, ejection is hindered. This sometimes causes such a problem that the ink is ejected in an unexpected direction (shift), or that the ink droplets are not ejected (no ejection). Further, what adheres to the ejection outlet surface during the recording operation is not just the ink, but also foreign matter such as paper dust, since the recording head and the recording paper move relative to each other while holding an extremely small gap between them.

In order to eliminate such an inconvenience as the above due to the use of liquid ink as the recording agent, a head performance recovery means is provided in the ink jet recording apparatus, for maintaining the ejection outlet surface or restoring the ejection outlet surface to the normal condition. This ink jet head performance recovery means possesses a distinctive structure which cannot be found in other types of recording apparatuses.

As for the performance maintaining or recovering means, there is a capping means for preventing the faulty ejection caused by a plugged orifice or orifices, a wiping means for preventing the ejection direction from being deviated by the solidified ink adhering to the ejection outlet surface, or the like. The capping means is used not only for preventing the faulty ejection but also for preventing the ejection orifices from drying up. This can be accomplished by keeping it humid within the cap. As the wiping means, a wiping member is provided, which wipes away the foreign matter such as the waste ink by being placed in contact with the ejection outlet surface, and then, being moved relative to the ejection outlet surface. The wiping member is generally a blade formed of elastic material such as rubber.

However, such a wiping means also has its own problems. For example, after being in service for a long time, its begins to lose its function, or if the amount of ink to be wiped suddenly increases, its function temporarily deteriorates, and therefore, it becomes difficult for the wiping means to sustain its performance recovery function. Further, the ink, foreign matter, or the like accumulates on the blade as the wiping means, and is sometimes transferred back to the ejection outlet surface, causing thereby the misaimed ejection or the ejection failure if it plugs the ejection orifices.

There is another problem such that, when the ejection outlet surface of the recording head is wiped by the blade, a portion of the ink wiped off the ejection outlet surface is sometimes splashed within the recording apparatus as the blade springs back because of its elasticity, contaminating thereby the apparatus interior. The major portion of the ink left on the blade without being wiped away and the foreign matters such as paper dust remain adhering to the blade. However, as the liquid contents evaporate from the ink remaining on the blade, not only the ink itself increases its viscosity, but also helps the foreign matters such as paper dust stick firmly to the blade surface and accumulate there. This mixture of the ink with higher viscosity and the accumulated foreign matter is sometimes transferred back to the ejection outlet surface, causing thereby the faulty ejections such as ejection failure or shift.

In an recording apparatus in which two or more recording heads (recording means) are arranged side by side, each containing one of two or more inks of a different color, to record color images, the ink transferred to the blade by wiping one of the multiple recording heads is sometimes mixed with the ink of the different color from the second recording head when the second recording is wiped, deteriorating thereby the image quality. In addition, in the color ink jet recording apparatus in which only a single blade is provided for wiping multiple recording heads, the amount of the ink adhering to the blade increases, which intensifies the ill effects from the blade contamination due to the waste ink, paper dust, ink mixing, or the like. It is of course possible to employ a different structure in which each recording head is provided with a dedicated blade. However, this brings different problems such as higher costs and the need for a larger space for the blade installation.

In order to prevent the above described degradation of the wiping performance, it is proposed to provide a cleaning means for cleaning the wiping means, wherein an ink absorbing member is generally provided as the most appropriate form of this type of cleaning means, and the ink absorbing means is made of porous material having excellent ink absorbing properties. This ink absorbing member is placed in contact with, and is moved relative to the wiping means such as the blade or the like, so that the foreign matter adhering to the blade is wiped away and the waste ink is absorbed away. However, even the absorbing material having the best cleaning performance loses its ink absorbing power as it keeps on absorbing the ink, and therefore, it is impossible to sustain reliably its performance for an extended period.

As described hereinbefore, in the ink jet recording apparatus, the ink in the liquid passage increases its viscosity as its water content or the like evaporates, and as a result, the ink becomes unsuitable for ejection, failing sometimes to be ejected by the ejection energy imparted to the ink. Such unsuitable ink must be forced out of the liquid passages to refresh the ink in the liquid passage. Generally speaking, a recovery means comprising a suction pump or the like is employed as the ink refreshing means. Also in this case, the ink having the increased viscosity may adhere to the ejection outlet surface when it is sucked out of the liquid passage by the pump or the like.

FIG. 20 is a schematic sectional view of a cap, depicting the cap movement during the performance recovery operation by suction, and at the same time, describing how the ink adheres to the ejection outlet surface during the capping operation. First, a cap 103 is airtightly placed on an ejection outlet surface 102 of a recording head 101, and a negative pressure is generated by a suction pump (unshown) connected to the cap 103, whereby the ink is sucked out of the ejection orifice. FIG. 20(*a*) shows a capping stage when the above described negative pressure has been almost canceled (capping stage in which the negative pressure is canceled to a degree at which the meniscus at the ejection orifice begins to hold) after the ink is sucked out. An hatched area 104 represents the sucked out ink. At the capping stage shown in FIG. 20(*a*), the inside of the cap 103 may be assumed to be almost entirely filled with the ink.

Next, the cap in the capping stage shown in FIG. 20(*b*) is moved away from the ejection outlet surface. As it is moved away, the ink at the interface between the ejection outlet surface 102 and ink 104 is affected by the adhering force of the ink and the negative pressure working still to such the ink out of the ejection orifice. Further, the ink tends to agglomerate due to its own surface tension. Therefore, the body of the ink 104 is constricted. in other words, the cross-sectional areas 105 of the ink body become smaller and weaker at the locations of the constriction, and finally, the bodies of ink are severed at the conditions.

FIG. 20(*c*) shows a capping stage immediately after the ink body is severed at the constricted spots, leaving spots of ink on the ejection outlet surface 102 as shown in the drawing. The amount of the ink remaining on the ejection outlet surface 102 at this time is more than what is left because of the ink mist generated during the actual recording operation. There is a tendency that the smaller the surface tension of the ink is, the larger this amount is, and that the smaller the ink repellent force of the ejection outlet surface is, the larger this amount is. Then, the larger the amount of the ink adhering to the ejection outlet surface 102 is, the larger is the extent of the contamination of the apparatus interior or the recording material (recording paper). Further, in the apparatus comprising the wiping means, the larger the amount of the ink adhering to the ejection outlet surface 102 is, the larger the loads imparted on the wiping blade and the wiper cleaner become, shortening thereby their service lives. Also, in the case shown in FIG. 20, the ink still remains within the cap ate the cap 103 is moved away, which causes problems such as dripping or splashing ink.

Further, the negative pressure still remains within the cap immediately after the ink sucking operation, and if the cap 103 is separated at this time, that is, immediately after the ink sucking operation, the atmospheric pressure is suddenly imparted to the internal space of the cap which still is holding the remaining negative pressure. This sudden pressure change and the mechanical compact at the time of the cap separation sometimes destroys the meniscus within the ejectoin orifice, and if this happens, the air enters deeper into the liquid passage beyond the ejection orifice, causing the faulty ejection.

During the actual recording operation of the ink jet recording apparatus, the cap is off the ejection outlet surface while the recording head is scanning the surface of the recording material. However, in an apparatus such as the color recording apparatus having a number of recording heads, it is not always that all of the multiple ejection orifices in a single recording head are activated, in other words, there are some recording heads (unused recording heads) to which recording data are not sent (don not record) while the cap is off. If the ink is not ejected from a certain ejection orifice for a given period, the ink ejection performance of this orifice declines, resulting in inferior image quality, because the ink increases its viscosity, or dries up. In order to maintain the normal condition of the ejection outlet surface by preventing this phenomenon, the ink is ejected with given intervals, in addition to being ejected in response to the recording date. Such an ink ejecting operation is called preliminary ejection.

During the aforementioned preliminary ejection, the ink is ejected within the cap of the recovery unit so that the recording material or the interior of the apparatus is not contaminated by the splashed ink, and is sucked by the unshown recovery pump into a container for the residual ink and is stored there. The recovery pump is generally positioned at the home position of the recording head. Therefore, in order to carry out the preliminary ejection operation, the carriage on which the recording head is mounted has to be returned to a position (home position) where the recording head can face the cap of the recovery unit, whether the recording is made mono-directionally or bidirectionally.

A small amount of ink remains in the cap at the moment when the cap is removed. This ink also sticks to the ejection outlet surface, causing sometimes the faulty ejection. In order to solve the problem related to this type of faulty ink ejection, a system as disclosed in Laid-Open Japanese Patent Application No. 151,059/1985 was proposed, in which the cap is connected to an air-inlet valve with a tube. In this system, the ink in the cap is sucked out after connection is established between the internal space of the cap and the atmosphere by opening the air-inlet valve, before the cap is separated from the ejection outlet surface. With use of this system, the amount of the ink remaining the cap becomes extremely small. However, the system is structurally complicated and makes the recovery means larger, which is against the recent trend of reducing the size of the ink jet recording apparatus, and the subsequent need for reducing the sizes of the cap and its peripheral mechanism.

Even if the air valve is integrally formed with the cap instead of using the valve and tube, the recovery means still becomes complicated, and also, in order for the valve mechanism to be effective, the concavity of the cap requires a certain volumetric size, which present another restriction against the cap size reduction. Further, some portions of the cap are made of elastic material in consideration of the airtightness between the cap and the ejection outlet surface, wherein the valve must be planted in a non-elastic material portion of the cap in order for the valve to operate reliably. This also makes it difficult to reduce the cap size.

There is also a chance in which the tube employed to connect the air-inlet valve and the cap is plugged with foreign matter and quits functioning as the connector.

Since the aforementioned structure in which the cap is provided with the air-inlet valve increases the cap size, it presents another problem, besides the size reduction related problem. This problem is related to the negative pressure needed to suck out the foreign matter adhering to the ejection outlet surface, and bubbles or the ink with increased viscosity in the ejection orifices. As the cap size increases, the amount of the ink to be sucked out increases, and as the amount of the ink to be sucked out increases, the amount of wasted ink increases, inviting thereby a problem such as a running cost increase.

As for the timing of the aforementioned preliminary ejection mode, it arrives with predetermined intervals, with no coordinated relation to the carriage position. If the preliminary ejection timing arrives during the backward movement of the carriage, in other words, while the carriage is moving towards the home position, the carriage movement is not interrupted and the preliminary ink ejection is carried out after the carriage returns to the home position. However, if the preliminary ejection timing arrives during the forward movement of the carriage, the backward recording movement of the carriage (recording by backward scanning) must be skipped in order for the carriage to return to the home position for the preliminary ink ejection. This wastes the time which otherwise could be spent for recording. Therefore, it becomes impossible to realize the high speed recording which is an inherent advantage of the bi-directional recording.

Further, when the ink jet recording is used, the recording is effected by making the ink permeate the recording material. Therefore, if the time allowed for the ink to permeate at different spots is changed, the tone gradation on the recording material sometimes changes. If this change occurs between the adjacent recording line, horizontal lines appear with intervals having the same width as the recording line spacing, affecting greatly the image quality. This difference in the ink permeation time is created because the scanning (moving) timing of the carriage and the recording timing are shifted between the adjacent lines by the preliminary ejection, which changes the ink permeation time. In particular, in the recording mode such as a fine mode in which high resolution recording is made, the aforementioned ill effect of the ink permeation time difference is much greater, and therefore, the tone gradation for a line recorded with an interruption for the preliminary ejection sometimes becomes different from those for the preceding and following lines, causing problems related to the image quality.

SUMMARY OF THE INVENTION

The present invention was made in consideration of the above described technical problems, and accordingly, the primary object of the present invention is to remove as much as possible the ink adhering to the ejection outlet surface of the recording means (recording head), so that the recording material or the interior of the apparatus is prevented from being soiled, and so that, if the apparatus comprises a wiping means, the performance of the wiping means is prevented from declining, to stabilize the ink ejection of the recording means, and to provide thereby an ink jet recording apparatus capable of sustaining excellent recording performance over a long time.

According to an aspect of the present invention, the ink jet recording apparatus in accordance with the present invention can prevent the throughput decline and the occurrence of the horizontal streaks, which are caused by the recording timing shift triggered by the preliminary ejection during the recording operation.

According to an aspect of the present invention, there is provided an ink jet recording apparatus comprising: a carriage for carrying recording means for effecting recording by ejection of ink on a recording material; a cap for capping an ejection outlet of the recording means formed in an ejection side surface; sucking means for sucking the ink out through the ejection outlet while the cap is closely contacted to the ejection side surface; clearance forming means for forming a clearance at a part of close-contact portion between the ejection side surface and the cap by relative motion between the cap and the carriage.

According to another aspect of the present invention, there is provided an ink jet recording apparatus comprising: a carriage for carrying recording means for effecting recording by ejection of ink on a recording material; a cap for capping an ejection outlet of the recording means formed in an ejection side surface; sucking means for sucking the ink out through the ejection outlet while the cap is closely contacted to the ejection side surface; an air communication opening, in the recording means, for communicating a space covered by the cap with an ambient air; and shut-off means for shutting off and opening the air communication opening.

According to a further aspect of the present invention, there is provided a recording unit mountable to a carriage of an ink jet recording apparatus having a cap for capping an ejection outlet of the recording means to effect recording, comprising: an ejection side surface having an ejection outlet; an air communication opening having an end engageable with shut-off means of the ink jet recording apparatus and another end to be covered by the cap.

According to a further aspect of the present invention, there is provided an ink jet recording apparatus comprising: a carriage for mounting a plurality of recording means for effecting recording by ejection of ink to a recording material; ink receptors provided at both outsides of a region in which the recording material passes; wherein the ink receptor receives the ink from at least one recording means for each inversion of scanning movement in a main scan direction during recording.

According to a further aspect of the present invention, there is provided a method of recovering an ink jet apparatus provided with a carriage capable of carrying recording means for effecting recording by ejection of ink on the recording material, comprising the steps of: capping an ejection side surface having an ejection outlet by a cap at least partly deformable; sucking the ink through the ejection outlet by sucking means while the cap being closely contacted to the ejection side surface; forming a clearance at least partly between the cap and the ejection side surface; operating the sucking means while the clearance is present.

According to a further aspect of the present invention, there is provided a method of recovering an ink jet recording apparatus having a carriage for carrying recording means for effecting recording by ejection of ink to a recording material, comprising: capping with a cap an ejection outlet formed in an ejection side surface of the recording means; sucking the ink through the ejection outlet while the cap is closely contacted to the ejection side surface, and while an air communication opening provided in the recording means for communication of a space closed by the cap with an ambient air, is being in a closed state; and sucking an inside of the cap while the air communication opening is in an open state.

With application of the present invention, the cap can be moved away during the capping operation, without destroying the meniscus at the ejection orifice or allowing a large amount of the ink to adhere to the ejection outlet surface. Further, the amount of the ink to be sucked away is reduced by being able to control reliably the communication between the cap concavity and the atmosphere, without complicating the cap structure and increasing the cap size. Further, it is possible to prevent the throughput decline and the appearance of the horizontal lines which are caused by the recording timing shift triggered by the preliminary ejection during the recording operation.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
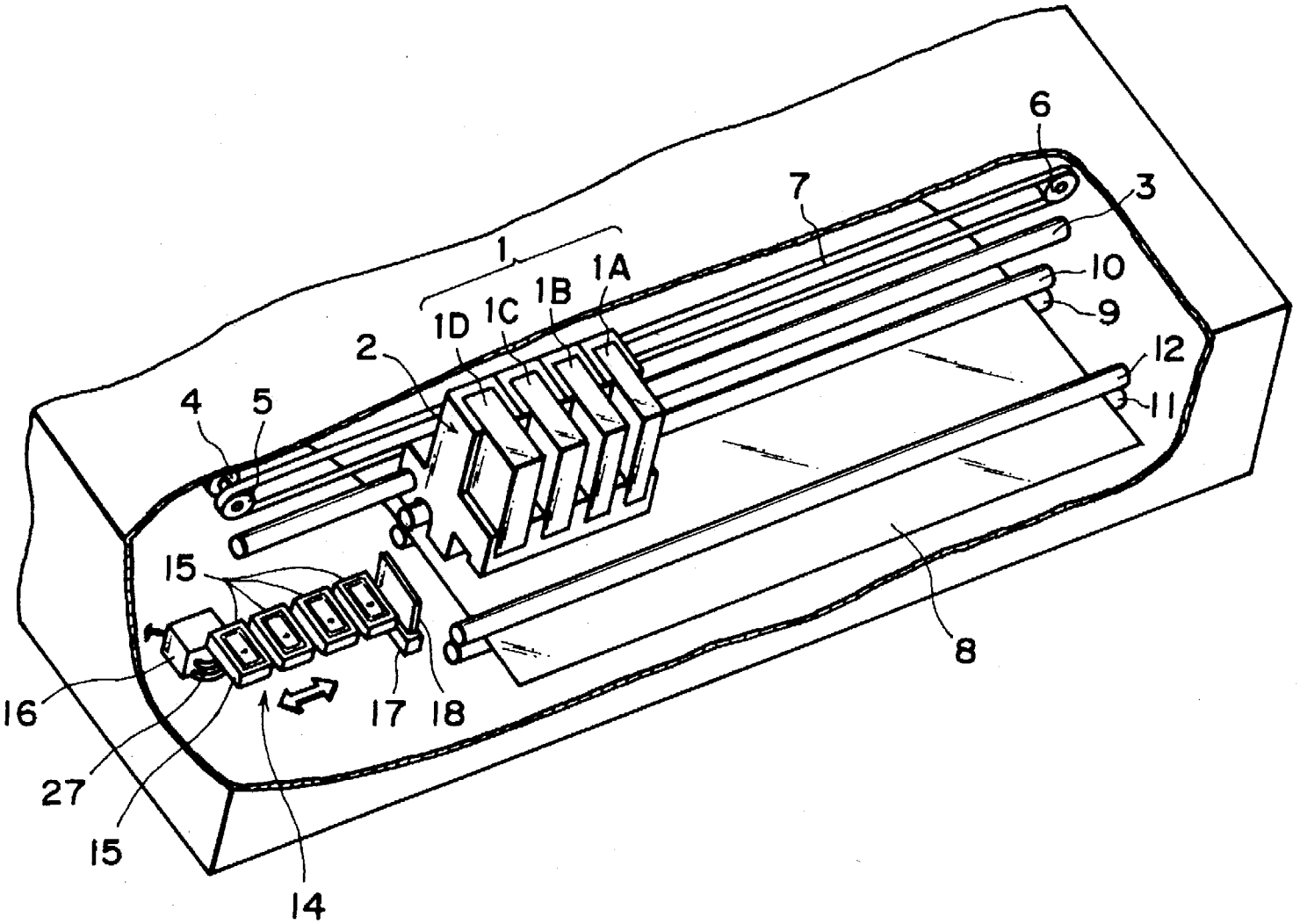
FIG. 1 is a partially cut out perspective view of an embodiment of an ink jet recording apparatus in accordance with the present invention, showing its essential structure.

Hereinafter, embodiments of the present invention are described referring to drawings. The same reference codes in different drawings designate the same sections or the sections having corresponding functions. FIG. 1 is a schematic perspective view of an ink jet recording apparatus according to the present invention, showing the essential structure of the preferred embodiment of the present invention. In FIG. 1, two or more (four) exchangeable head cartridges 1A, 1B, 1C and 1D are mounted on the carriage 2. Each of the head cartridges 1A to 1D has an ink container, at the top, and a recording head (ink ejecting member), at the bottom. In this embodiment, the recording means (recording head) comprises the head cartridges containing a combination unit of the recording head and ink container. Each of the head cartridges 1A to 1D also have a connector for receiving signals to drive the recording head, or the like. Hereinbelow, a recording means 1 (recording head 1, or head cartridge 1) refers to all of the recording means 1A to 1D or any given one of them.

Each of the multiple head cartridges 1 effects recording using a different color, and its ink container contains one of the inks of a different color, for example, black, cyan, magenta, or yellow. The exchangeable recording means 1 is mounted on a carriage 2 through a positioning step, and the carriage 2 has a connector holder (electrically connecting member) for transmitting driving signals or the like to the recording means 1, through the aforementioned connector.

The carriage 2 is supported by a guide shaft 3 place in the main structure of the apparatus, extending in the primary scanning direction to guide the forward or backward movement of the carriage 2. The carriage 2 is driven by a primary scanning motor 4, through a motor pulley 5, follower puller 6, and a timing belt 7, to control its position and movement. A recording material 8 such as printing paper or thin plastic film is held between two pairs of conveyer rollers 9 and 10, and 11 and 12, and is conveyed (paper feed) passing through a position (recording position) facing the ejection outlet surface of the recording 1, by the rotation of these conveyer rollers. The recording 8 is supported from behind by a platen (unshown), so that it can offer a flat recording surface at the recording position. The head cartridge 1 on the carriage 2 is held in such a manner that its ejection outlet surface protrudes downward from the carriage 2, and also, the ejection outlet surface remains parallel to the surface of the portion of the recording material 8 passing between two pairs of rollers.

The aforementioned recording head (recording means) 1 is an ink jet recording means which comprises electrothermal transducers and ejects the ink using the thermal energy. More particularly, the thermal energy generated by the electrothermal transducers is applied to the ink, which triggers film boiling in the ink, developing a bubble. The bubble causes pressure change as it grows or collapses, and this pressure change is used to eject the ink from an ejection orifice 22, effecting thereby recording.

Figure 2:
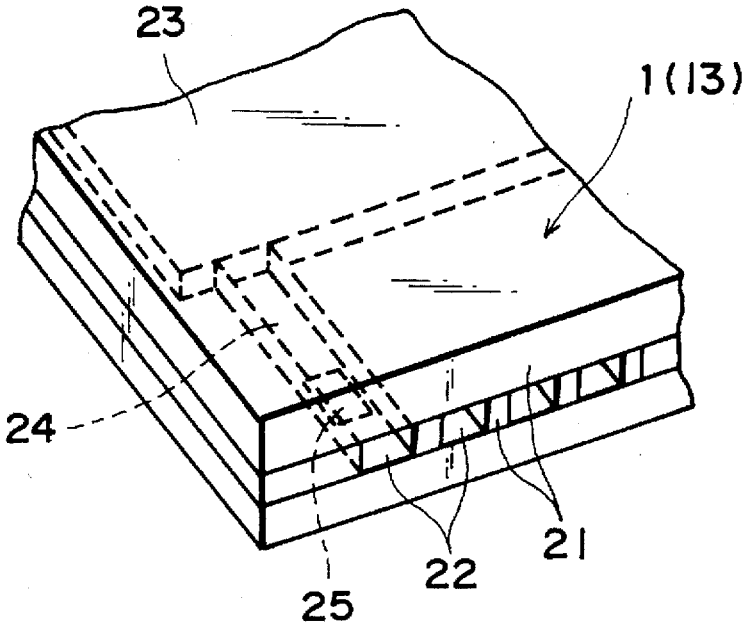
FIG. 2 is a schematic perspective view of a part of the recording means shown in FIG. 1, depicting the structure of its ink ejecting portion.

FIG. 2 is a schematic partial view of the recording head 1, showing the structure of the ink ejecting portion (recording head portion) thereof. In FIG. 2, on an ejection outlet surface 21 facing the recording material 3 with presence of a predetermined gap (for example, 0.5 to 2.0 mm), two or more ejection orifices 22 are formed with a predetermined pitch. A common liquid chamber 23 and each of the ejection orifices are independently connected with a liquid passage 24, and on the bottom wall surface of the liquid passage 24, an electrothermal transducer (exothermal resistor or the like) 25 is placed. In this embodiment, a predetermined number of the recording heads 1 are arranged on the carriage 2 in such a manner that the ejection orifices 22 are aligned in the direction perpendicular to the scanning direction of the carriage 2.

Within the recording head 1 having the above described structure, the electrothermal transducer 25 is driven (power is supplied) in response to the image signals or ejection signals to trigger film boiling in the ink within the liquid passage 24, and the pressure generated under this film boiling condition is used to eject the ink from the ejection orifices.

Referring to FIG. 1, at the home position of the recording head 1 (or carriage 2) located at the left end of the recording apparatus, a recovery system unit 14 is provided, which comprises a cap unit and a pump unit. The cap unit comprises two or more (four in this embodiment) caps 15, each being placed to face one of the ink ejecting portions 13 (recording head) of the head cartridge 1, and the pump unit 16 is individually connected to each of the caps 15, with a tube 27 or the like. The cap unit (or each of caps 15) can be vertically moved in synchronization with the approaching or departing movement of the carriage 2, so that when the carriage 2 is at the home position, each of the caps 15 can be tightly placed on one of the ejection outlet surfaces 21 of the recording head, sealing (capping) thereby the ejection orifice 22. This capping prevents the ink evaporation from the ejection orifice, preventing in turn the ink viscosity increase or solidified ink adhesion within the ejection orifice, and ultimately, preventing the occurrence of a faulty ejection.

When the recording head 1 ejects the ink in a faulty manner, a negative pressure is generated by operating the pump unit 16, with the caps on, and the suction generated by this negative pressure is used to suck out the ink from the ejection orifice 2, recovering thereby the ejection performance, in other words, an absorbency recovery operation is performed. Further, the recovery system unit 14 comprises a blade 18 being held by a blade holder 17 at a location between the cap and the recording material conveying member. The blade 18 serves as a wiping member formed of elastic material such as rubber, and wipes clean the ejection outlet surface 21 in coordination with the movement of the carriage 2. In this embodiment, the blade 18 is set at a projecting position (wiping position) or a retracted position (wiping position) as the blade holder 17 is moved up or down by a blade moving mechanism (unshown) being driven by the movement of the carriage 2. When the blade 18 is at the projecting position (up position), foreign matter such as the ink adhering to the ejection outlet surface 21 can be wiped by the tip of the blade 18, and when the blade 18 is at the retracted position (down position), it does not touch (interfere with) the ejection outlet surface 21.

Further, in this embodiment, the wiping operation by the blade 18 is carried out only when the carriage 2 is moving from the left side (recovery unit 14 side) to the right side of FIG. 1. This is because the blade 18 is located between the capping unit 15 and the recording material conveying system. That is, if the ejection outlet surface 21 is wiped when the carriage 2 moves from the right to the left in the figure, there is a possibility that the elasticity of the blade 18 may throw the wiped ink toward the recording material conveying system and the thrown ink may be splashed on the recording material 8 and soil it. If there is no possibility for such a problem, the wiping operation may be carried out in both directions.

Figure 3:
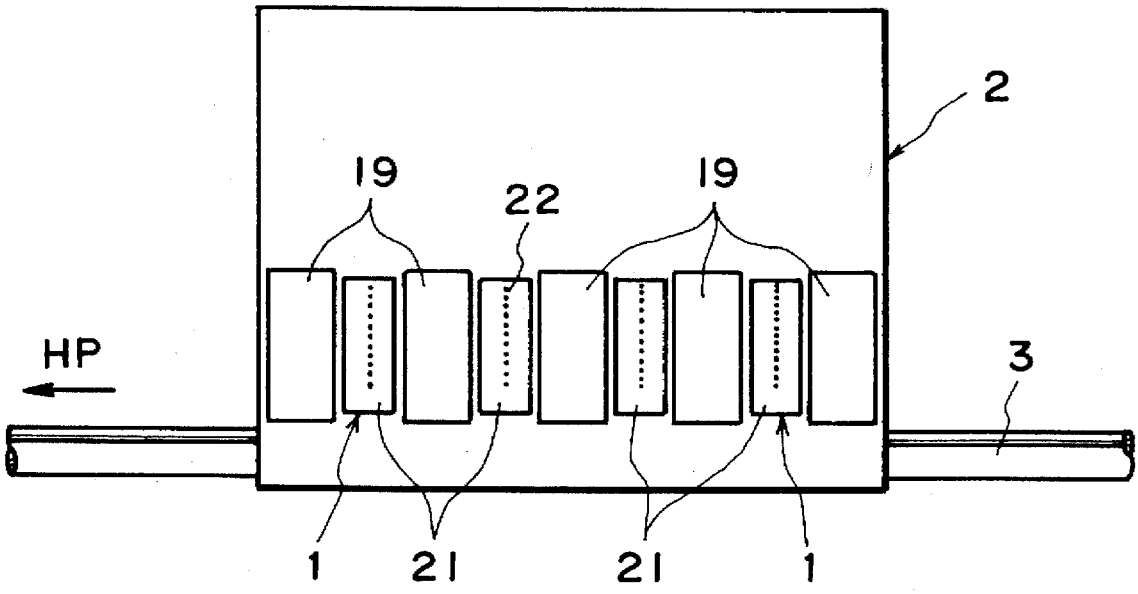
FIG. 3 is a schematic plan view of the bottom of the carriage shown in FIG. 1.
Figure 4:
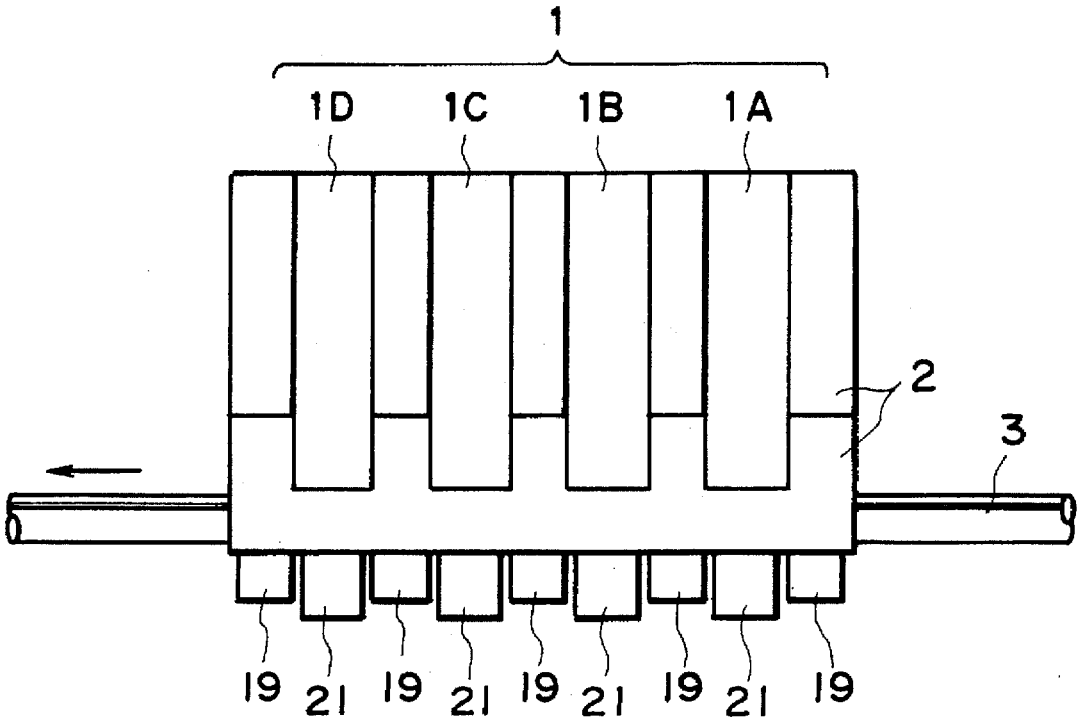
FIG. 4 is a schematic front view of the carriage shown in FIG. 1.

FIG. 3 is a plan view of the carriage 2, as seen from the bottom, and FIG. 4 is a front view of the carriage 2. In FIGS. 3 and 4, the ink absorbing members 19 (total of five) are fixed on the bottom surface of the carriage 2, in such a manner as to sandwich the ejection outlet surfaces 21 of the recording heads, in other words, with the appearance of one on each side of the ejection outlet surfaces of the respective recording heads 1 as shown in the drawings. These ink absorbing members 19 serve as cleaning means for cleaning the blade 18, and are made of ink corrosion-resistant, highly ink-absorbent, porous material. Further, as shown in FIG. 4, the ink absorbing members 19 are possitioned slightly below the ejection outlet surfaces 21 so that they do not rub against the recording material 8 during the recording operation.

In the ink jet recording apparatus, if the ejected ink droplet lands on an inaccurate location of the recording material 8, a white steak or an opposite black steak may appear. As a countermeasure for this type of image degradation, the gap between the ejection outlet surface 21 of the recording head 1 and the recording material 8 is minimized so as to minimize the landing error of the ink droplet, which in turn improves the image quality. However, after the recording material 8 absorbs the ink, the water content becomes quite different between the surface where the ink is absorbed and the reverse side, and between the areas where the ink is absorbed and not absorbed. This difference in the water content causes uneven expansion and contraction of the recording material 8, which sometimes produce a swelling pattern called cockling. If the recording material 8 becomes full of cockling or curled when the gap between the recording head 1 and the recording material 8 is extremely small, the recording head 1 touches the recording material 8, which creates an inconvenience of a soiled recording surface. Therefore, the gap between the recording head 1 and recording material 8 is set at the minimum width, within a range in which both do not touch each other even when deformation such as cockling is present on the recording paper.

In this embodiment, in consideration of the importance of the positional accuracy of the ink landing, the aforementioned ink absorbing member 19 provided on the bottom surface of the carriage 2 for cleaning the blade is positioned slightly recessed below the recording head 1 which protrudes downward from the carriage 2. Further, the ink absorbing member 19 swells by absorbing the ink, and in consideration of the Mount of this swelling, it is recessed from the recording head 1 by approximately 0.5 mm.

Figure 5:
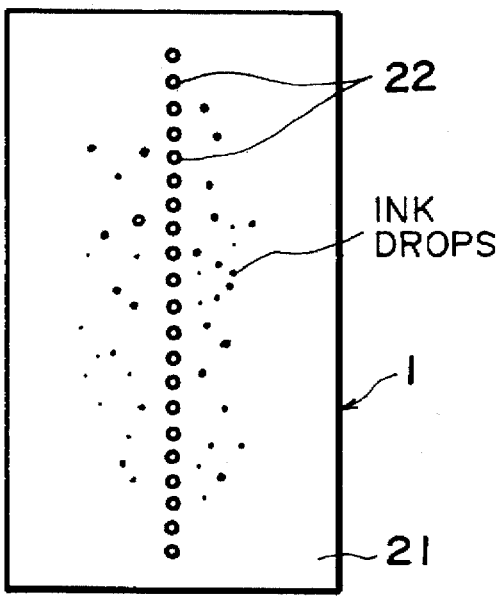
FIG. 5 is a schematic front view of the recording means, depicting the appearance of the ejection outlet surface with adhering ink droplets.
Figure 6:
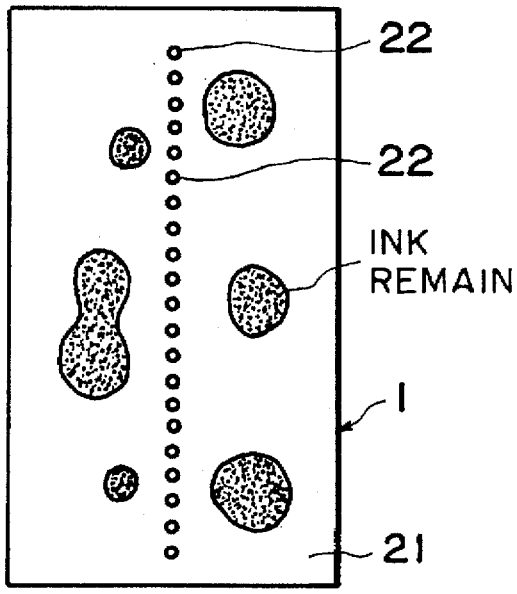
FIG. 6 is a schematic front view of the recording means, depicting the appearance of the ejection outlet surface with residual ink dots.
Figure 21:
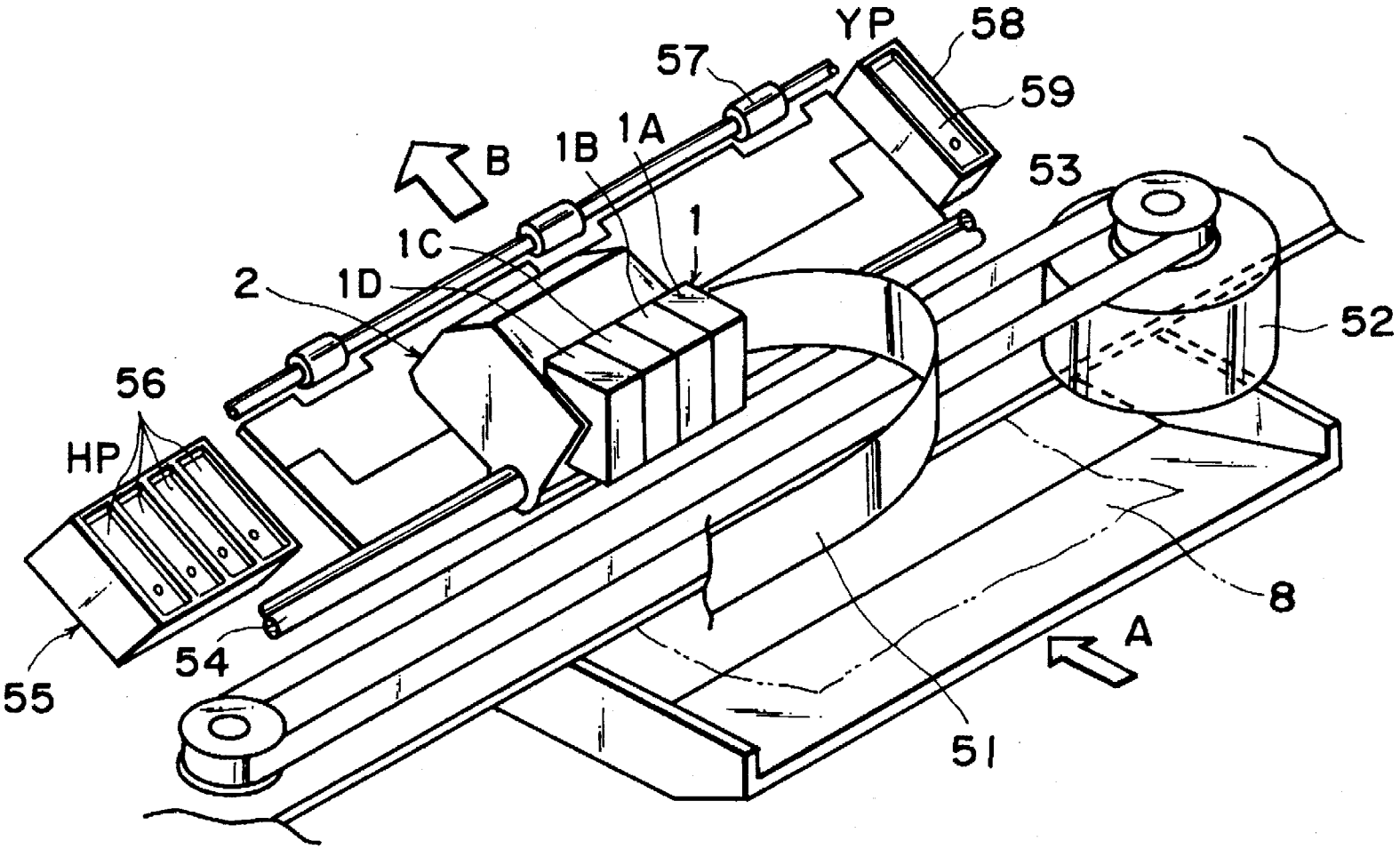
FIG. 21 is a schematic perspective view of the ink jet recording apparatus in accordance with the present invention, depicting the essential structure of the seventh embodiment of the present invention.

FIG. 5 is a schematic front view of the recording head 1, showing the ejection outlet surface 21 in a wet condition after the image recording. FIG. 6 is a schematic front view of the recording head 1, showing the ejection outlet surface 21 to which the ink is adhering after the absorbency recovery operation. Generally speaking, while the ink is ejected for recording, the ejection outlet surface 21 of the recording head 1 gets wet and looks as shown in FIG. 21. When a substantial amount of the ink droplets adheres around the ejection orifices 22 as shown in FIG. 5, the ink ejection is affected, triggering such problematic phenomenons that the ink is ejected in the unintended direction (shift), that the ink droplet is not ejected (no ejection), or the like. Also, the absorbency recovery operation makes the ink adhere to the ejection outlet surface 21, as shown in FIG. 6, and in this case, the amount of the adhering ink is more than in the case of just getting wet by the recording operation. Therefore, the ejection outlet surface 21 must be wiped (cleaned by wiping) by the blade 18 after the absorbency recovery operation, or with predetermined intervals (before the faulty ejection is triggered).

Figure 7A:
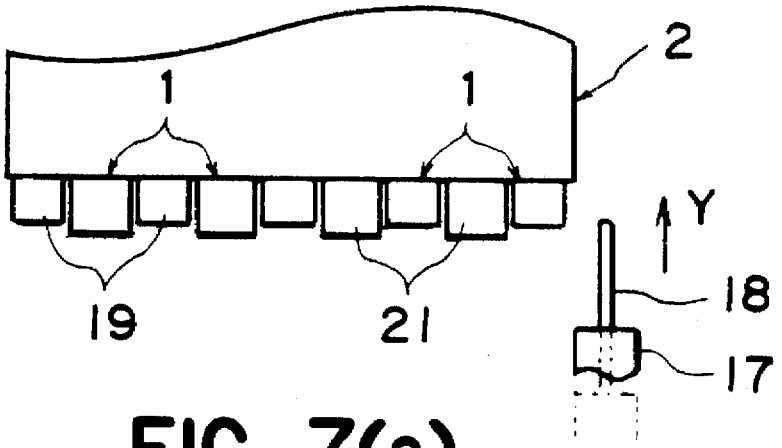
FIGS. 7(*a*)–(*c*) is a schematic front view of the recording means shown in FIG. 1, depicting the operation for wiping the recording means, and the blade cleaning operation.
Figure 7B:
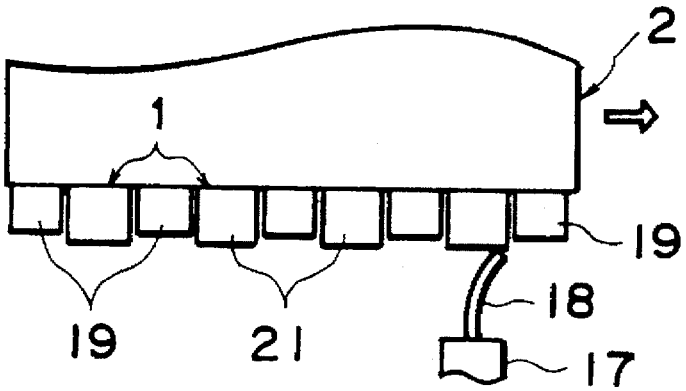
Figure 7C:
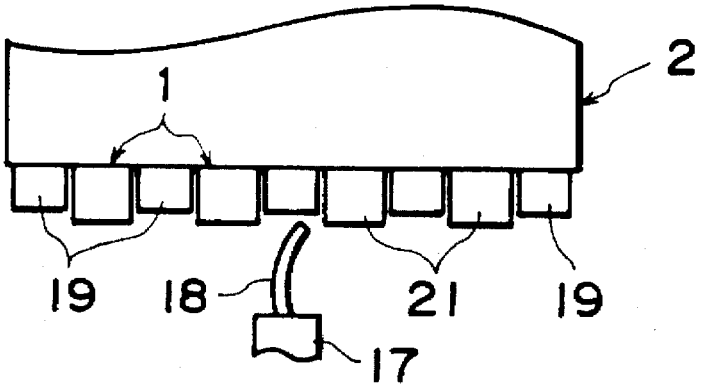
Figure 8A:
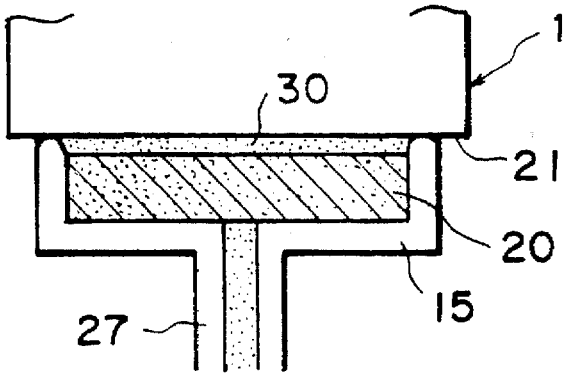
FIGS. 8(*a*)–(*d*) is a partially cut out schematic view of the first embodiment of the present invention, describing the absorbency recovery operation.
Figure 8B:
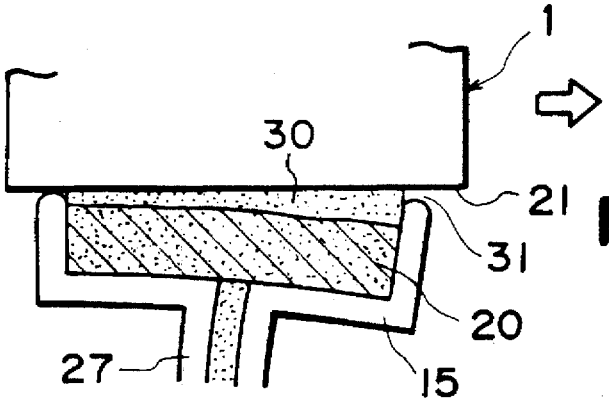
Figure 8C:
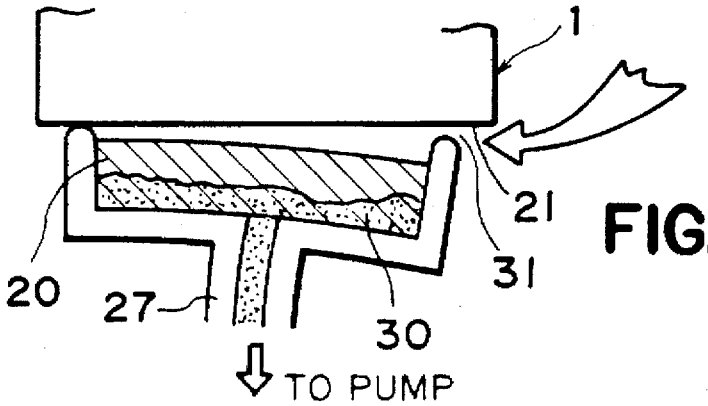
Figure 8D:
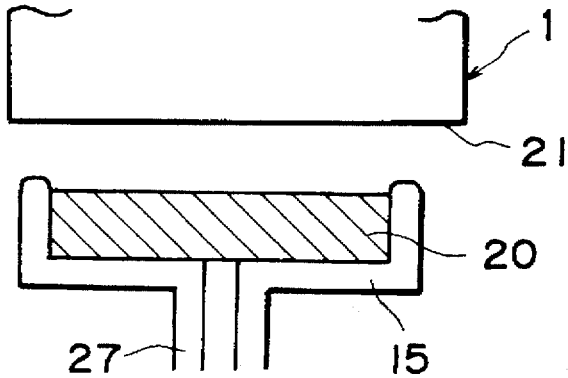

FIG. 7 schematically describes the wiping operation of this embodiment. As described hereinbefore, the wiping operation of this embodiment is carried out only when needed, and while the carriage 2 is moved from the home position side (left side in FIG. 7) to the recording material conveying system side (right side in FIG. 7). FIG. 7(*a*) shows the condition just before the wiping operation begins, and at this time, the blade 18 is elevated in the arrow Y direction, from the waiting position to a position (wiping position) where the blade 18 enters the passage of the recording head by the optimum amount for wiping the recording head 1, and is stopped there. Next, as shown in FIGS. 7(*b*) and 7(*c*), the carriage 2 carrying the recording head 1 is horizontally moved from left to right, whereby the blade 18 altermately touches each of the ink absorbing members 19 fixed on the bottom of the carriage 2 and each of the ejection outlet surfaces 21 of the recording head 1 protruding from the carriage 2 and wipes away the foreign matter such as the ink adhering to the ejection outlet surface 21. After serially coming in contact with all of the ink absorbing members 19 and the ejection outlet surfaces 21, the blade 18 is moved in the direction opposite to the arrow Y direction (lowered) to the retracted position where it waits.

As shown in FIG. 7, the ink absorbing members 19 for blade cleaning are positioned on both sides of each of the recording head 1, and therefore, the ink wiped off from each of the ejection outlet surfaces 21 is sequentially absorbed by the ink absorbing member 19, reducing constantly the amount of the ink left behind on the blade 18 to a minimum. This can prevent color mixing which may occur when the ejection outlet surface 21 of next recording head 1 is wiped. However, the ink absorbing capacity of the ink absorbing member 19 is limited, and therefore, when the amount of the ink adhering to the ejection outlet surface 21 is large, there is a possibility that the ink cannot be sufficiently absorbed.

FIG. 27 is a schematic sectional view of the cap and its surrounding area of the ink jet recording apparatus according to the present invention, depicting the ink sucking operation of the first embodiment. In FIG. 27, a cap 15 is made of rigid material, and comes in contact with the ejection outlet surface 21 in a manner to seal the surface it covers. The concavity of the cap 15 is occupied by a porous ink absorbing member 20, which fills the cavity almost to the rim so that it is places close to the ejection outlet surface 21 during the capping operation, as shown in FIG. 27(*a*). An area 30 hatched in a higher density represents the ink sucked out of the ejection orifice (or sucked into the cavity).

During the capping operation, first, the cap 15 is made to airtightly contact the ejection outlet surface 21, and then, the suction pump 16 (FIG. 1) is started to generate the negative pressure in the cap 15, through the tube 27, whereby the ink is sucked from the ejection outlet surface 21. Then, the suction pump 16 is stopped. FIG. 27(*a*) shows the positional relation between the cap 15 and the ejection outlet surface 21 immediately after the suction pump 16 is stopped. In this state, the negative pressure within the suction pump 16 will have been almost canceled by sucking out a give amount of the ink. In other words, the negative pressure will have sufficiently diminished without reaching a point at which the meniscus of the ejection orifice 22 begins to hold. Here, if the cap is pulled away from the ejection outlet surface 21 while the negative pressure is still strong, the atmospheric pressure is suddenly imparted within the concavity of the cap 15. It is possible for such an abrupt change of pressure to destroy the meniscus at the ejection orifice 22 and allow the air to enter the ejection orifice 22, causing thereby the faulty ejection.

Figure 18:
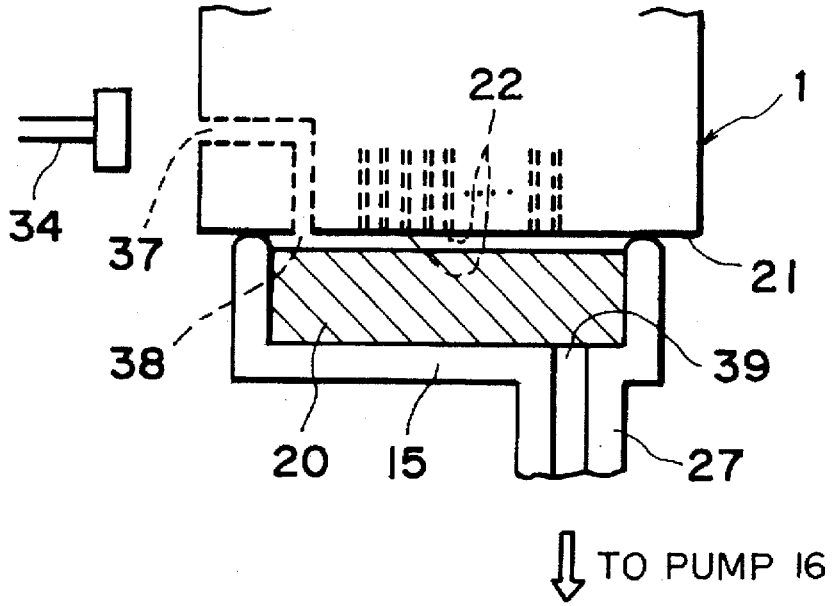
FIG. 18 is a schematic sectional drawing, presenting a preferable positional arrangement of the cap leaking means in the fifth embodiment of the present invention.

In the state shown in FIG. 27(*a*), the concavity of the cap 15 is almost entirely filled with the ink, in other words, the ink absorbing member 20 is saturated with the ink, having almost no absorbency. If the cap is separated in this condition, a large amount of the ink will be left on the ejection outlet surface 21 as shown in FIG. 18. Therefore, in this embodiment, the carriage 2 is slightly displaced to the right in the drawing to create a gap 31 between the carriage 2 and ejection outlet surface 22, which serves as a micro vent at the interface of two components. The amount of the slight displacement of the carriage 2 for this purpose is determined to be as small as possible while allowing the seal to be broken between the cap 15 and ejection outlet surface 21. This is because the gap 31 made at the interface is better to be small to reduce the suction time and the amount of suction. Incidentally, the term, "interface," in the above statements means the contact surface where the cap 15 meets the ejection outlet surface 21 when the cap 15 covers the ejection orifice 22. As to a means for forming the gap, that is, a gap forming means, a means for giving vernier movement, or the like is used to move the carriage 2.

FIG. 27(*b*) shows the condition of the concavity of the cap 15 immediately after the carriage is slight displaced from the location shown in FIG. 27(*a*). After the gap 31 is created as shown in FIG. 27(*b*), the suction pump 16 (FIG. 1) is restarted. The state of the concavity of the cap 15 after the suction pump 16 is restarted is shown is FIG. 27(*c*). In the state shown in FIG. 27(*b*), the cap 15 has a leak (is open), and therefore, only the ink within the cap 15 (the ink retained in the ink absorbing member 20 in the drawing) is sucked by the restarted suction pump 16 through the tube 27, as shown in FIG. 27(*c*), whereby the porous ink absorbing member 20 in the cap 15 recovers its ink absorbing capacity. Further, in the state shown in FIG. 27(*c*), almost entire ink on the ejection outlet surface 21 is absorbed by the ink absorbing member 20 because the porous ink absorbing member 20 is extremely close to the ejection outlet surface. Thus, the ink absorbed in the ink absorbing member 20 is also sucked through the tube 27.

Then, the carriage 2 is returned to the previous position, that is, the position shown in FIG. 27(*a*), where the ink absorbing member 20 with sufficiently recovered ink absorbing capacity is once again placed close to the entire area of the ejection outlet surface 20, reducing further the residual ink on the ejection outlet surface 21.

After the remaining ink on the ejection outlet surface 21 is absorbed by the ink absorbing member 20, the cap 15 is separated from the ejection outlet 21. FIG. 27(*d*) shows the state after the cap is separated. The sucking operation by the suction pump 16 is stopped as soon as the sufficient amount of the ink is sucked from the ink absorbing member 20. Thus, the absorbency recovery operation is completed, leaving hardly the ink on the ejection outlet surface 21, as shown in FIG. 27(*d*). Further, since the amount of the ink lift on the ejection outlet surface 21 by the performance recovery sucking is reduced to almost nothing, it becomes possible to reduce significantly the load imparted on the blade 18 and ink absorbing member 19 (blade cleaner) when the ejection outlet surface 21 is wiped by the blade 18 shown in FIG. 17.

Now then, in consideration of the airtightness between the can 15 and the ejection outlet surface 21, the cap 15 is preferred not to be as rigid as the rigid cap shown in FIG. 27, but to be made of elastic material, and if not, at least its contact surface (sealing surface) of the cap which comes in contact with the carriage 2 is preferred to be made of elastic material. As one example of such a cap, FIG. 8 shows a modified version of the cap of the first embodiment. This cap is entirely made of the elastic material.

FIG. 8 is a schematic sectional view of a cap made entirely of the elastic material, depicting another operation for sucking the ink. The operational stages shown by FIGS. 8(*a*), 8(*b*), 8(*c*), and 8(*d*) correspond to those shown by FIG. 27(*a*), 27(*b*), 27(*c*), and 27(*d*), respectively. The main difference between FIG. 8 and FIG. 27 is in the slight displacement of the carriage 2 shown in FIGS. 8(*b*) and 8(*c*). Since the cap is deformable in this modification, the amount of the carriage displacement necessary for creating the cap between the cap and the ejection outlet surface 21 has only to be sufficient for deforming the cap itself, which gibes another reason why the elastic cap is preferable to the rigid one.

Figure 9A:
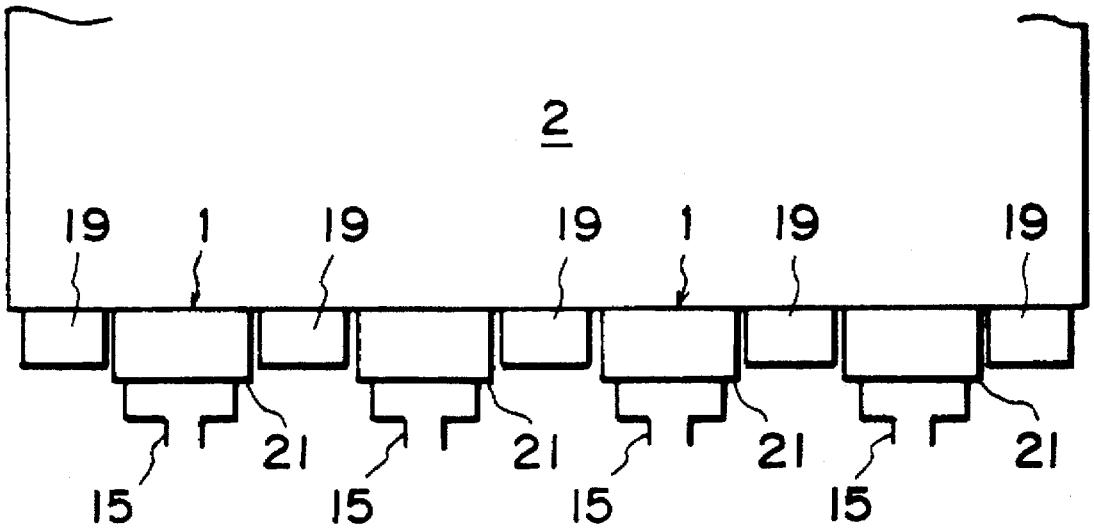
FIGS. 9(*a*) and (*b*) is a schematic drawing describing the cap leak operation in the first embodiment of the present invention.
Figure 9B:
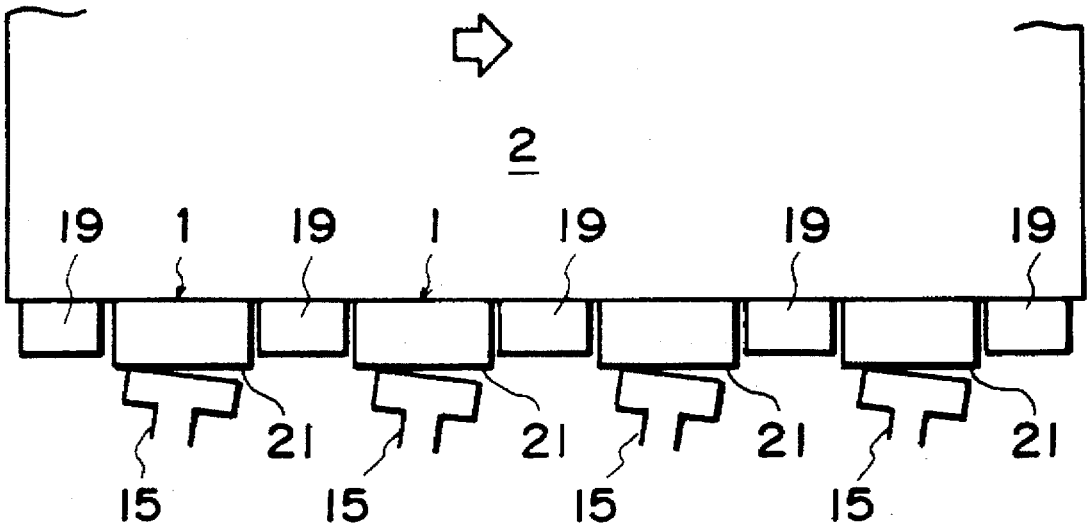

FIG. 9 shows another cap arrangement in which two or more caps are provided for a corresponding number of recording caps; FIG. 9(*a*) showing the operational stage in which the caps are squarely on, and FIG. 9(*b*) showing the stage in which the caps has been slightly displaced, wherein the states in FIGS. 9(*a*) and 9(*b*) correspond to those in FIGS. 27(*a*) and 27(*b*), and FIGS. 8(*a*) and 8(*b*). Referring to FIG. 9, each recording head 1 is provided with its own cap 15, but two or more recording heads may be covered with a single cap.

Hereinafter, and endurance test is described, which was conducted under the following various conditions for testing the structure of an absorbency recovery system 14, and confirming the effect of the suction mode in which the cap 15 was slightly displaced. In this test, the blade 18 was 0.7 mm thick, 12.0 mm wide, and 8.0 mm long, and the margin of the blade protrusion toward the ejection outlet surface 21 during the wiping operation was 1.5 mm. The moving speed of the carriage 2 during the wiping operation was 200 mm/sec. The recording head 1 used for this test had 128 ejection orifices and its resolution was 400 dpi. the absorbency recovery and wiping operations were carried out each time an A4 size recording material was finished. The amount of the slight displacement of the carriage 2 for shifting the cap 15 during the absorbency recovery operation was 0.4 mm. As for the test environment, the temperature was set at 35° C., and the humidity was set at 80% to 90%, being hot and humid. In other words, a sever environmental condition was set in which the amount of ejected ink was large, more ink adhering to the ejection outlet surface 21, and in addition, the ink was difficult to dry.

The recording was made at a recording ratio of 100%, that is, solid black recording, increasing thereby the amount of adhering ink to the maximum. While 5000 pieces of A4 size recording material were run for the endurance test, no faulty ejection such as shifting or no ejection was observed. Another endurance test was conducted for comparison, in which the cap leak (opening by slight movement of the carriage) sequence was eliminated during the absorbency recovery operation. During this test, the faulty ejections or color mixing occurred after 1000 pieces or so were recorded. These tests proved that the service life of the ink jet recording apparatus comprising the blade 18 and blade cleaner 19 could be immensely improved in terms of sheet counts, by providing a means for creating the cap leak and sucking the ink within the concavity of the cap.

In this embodiment, four recording heads 1 (head cartridges) as shown in FIG. 9 are used for color recording, but the number of the recording head is not limited to four. It may be one or other number beside one. This embodiment also solves a problem peculiar to the color recording, that is, the color mixing, and therefore, it is extremely effective when applied to the color recording apparatus.

Further, in this embodiment, the slight displacement of the carriage 2 is in the primary scanning direction, but the direction of the slight displacement is not limited to the primary scanning direction. It may be in the secondary scanning direction (paper feed direction). However, when the slight displacement is in the primary scanning direction, an existing means or structure can be utilized with a simple modification in the control method or the like. Therefore, the primary scanning direction is preferable to other directions, in teams of size reduction or mechanical simplification.

As for the gap forming means, the cap itself may be moved vertically, horizontally, or diagonally, instead of slightly displacing the carriage 2. However, the slight movement of the carriage 2 in the primary scanning direction is also preferable to this cap moving setup, just as it is preferable to the movement in the direction other than the primary scanning direction.

Further, in this embodiment, two or more recording heads are employed and the relative movements between the caps and corresponding ejection outlet surfaces 21 are in the same direction. However, in the modified version of this embodiment in which the caps themselves are moved, each cap may be moved in the different direction. Needless to say, the same direction is preferable also in this modified version, in terms of the size reduction and simplification of the apparatus.

Figure 10A:
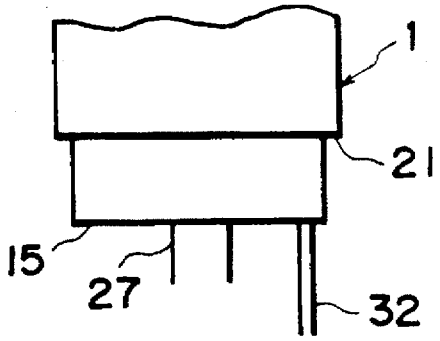
FIGS. 10(*a*) and (*b*) is a schematic drawing describing the cap leak operation in the second embodiment of the present invention.
Figure 10B:
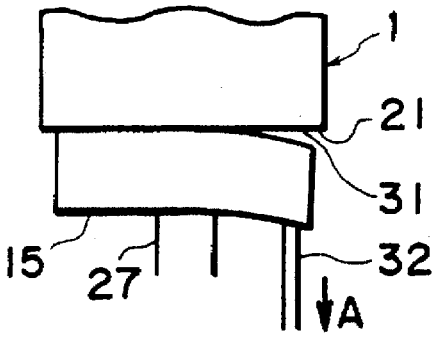

FIG. 10 is a schematic view of the cap and the ejection outlet surface 21 of the ink recording apparatus according to the present invention, describing the absorbency recovery operation of the second embodiment of the present invention. In this embodiment, the airtight contact between the cap 15 and the ejection outlet surface 21 is caused to leak by pulling a portion of the cap 15, and thereby, deforming the cap 15 which is formed of the elastic material. In order to pull the cap 15, a leak causing lever 32 is provided on the cap 15. The leak lever 32 is moved in the arrow A direction with a predetermined timing. While the cap 15 is sealing the surface of the ejection outlet surface 21, no force is imparted on the leak lever 32 to move it in the arrow A direction. The structure in the other portion of this embodiment is substantially the same as the first embodiment shown in FIGS. 1 to 9, and 27.

While the cap 15 is sealing the ejection outlet surface 21 as shown in FIG. 10(*a*), the ink is sucked from the ejection orifices 22. Next, the leak lever 32 is moved in the arrow A direction as shown in FIG. 10(*b*), whereby a portion of the cap 15 which is sealing the ejection outlet surface 21 is separated. As a result, as leak is established between the concavity of the cap 15 and the atmosphere. Meanwhile, the suction is continued by the suction pump 16 (FIG. 1) under the leak condition shown in FIG. 10(*b*), whereby the almost entire residual ink on the ejection outlet surface 21 is eliminated as it is in the aforementioned first embodiment.

Figure 11A:
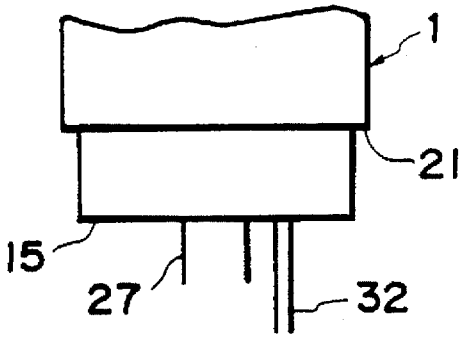
FIGS. 11(*a*) and (*b*) is a schematic drawing describing the cap leak operation in the modified second embodiment of the present invention.
Figure 11B:
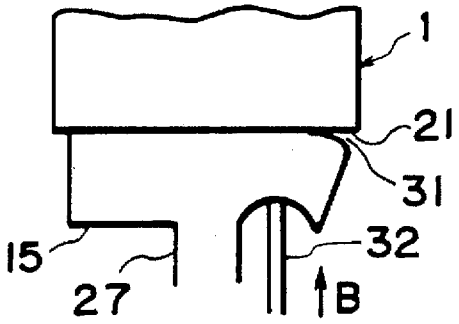

FIG. 11 is a schematic drawing showing a partially modified version of the second embodiment presented in FIG. 10. FIG. 11(*a*) shows the state in which the cap is sealing the ejection outlet surface 21, had FIG. 11(*b*) shows the state in which the leak is established between the cap concavity and the atmosphere. In the case of the structure shown in FIG. 10, the leak lever 32 is moved in the arrow A direction, that is, pulled, but in the case of the structure shown in FIG. 11, the leak lever 32 is moved in the opposite direction (in the arrow B direction), that is, pushed. Referring to FIG. 11, first, the ink is sucked from the ejection orifices 22 while the cap is sealing the ejection outlet surface 21 as shown in FIG. 11(*a*). Next, the leak lever 32 is moved in the arrow B direction as shown in FIG. 11(*b*), whereby a portion of the cap 15 is pushed to deform the cap 15. As a result, the leak is established between the concavity of the cap 15 and the atmosphere. Meanwhile, the suction is continued by the operation of the suction pump 16 (FIG. 1) under the condition as shown in FIG. 11(*b*), whereby the almost entire residual ink on the ejection outlet surface 21 is eliminated as it is in the first embodiment of the present invention.

Figure 12A:
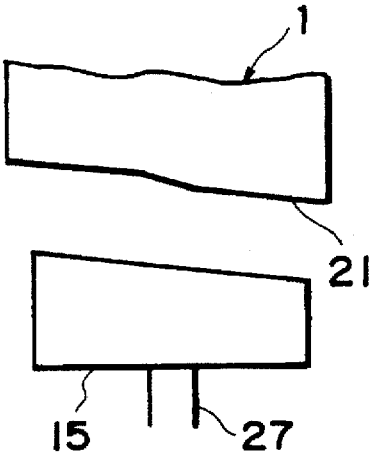
FIGS. 12(*a*)–(*c*) is a schematic drawing describing the cap leak operation in the third embodiment of the present invention.
Figure 12B:
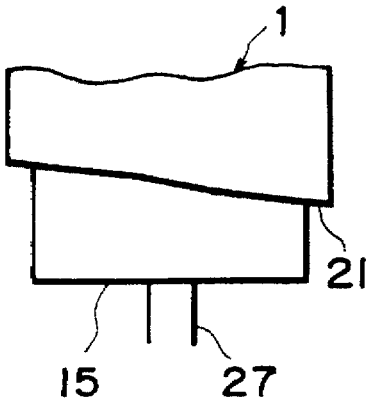
Figure 12C:
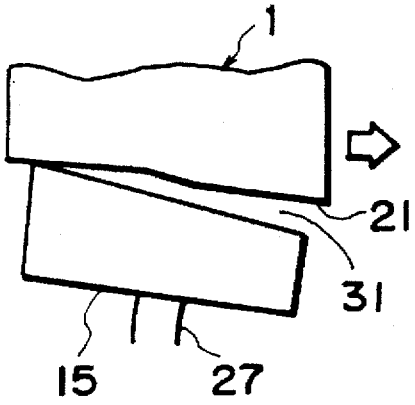

FIG. 12 is a schematic view of the cap 15 and the ejection outlet surface 21 of the ink jet recording apparatus according to the present invention, describing the absorbency recovery operation in the third embodiment of the present invention. FIG. 12(*a*) shows the state in which the cap 15 is apart from the ejection outlet surface 21; FIG. 12(*b*) shows the state in which the cap 15 is sealing the ejection outlet surface 21; and FIG. 12(*c*) shows the state in which the leak is established by slightly displacing the carriage 2. In this embodiment, the ejection outlet surface 21 of the recording head 1 and the contact surface of the cap 15 are slanted with reference to the direction in which the carriage 2 is slightly displaced (to the right in FIG. 12). The angle of the contact surface of the cap 15 is matched with that of the ejection outlet surface 21. In the state shown in FIG. 12(*a*), the ejection orifices 22 are sealed. The cap 15 of this embodiment may be made of either the rigid material or the elastic material, as described in the first embodiment. However, the elastic material is preferable in consideration of the airtight contact to be established between the cap 15 and the ejection outlet surface 21.

Referring to FIG. 12, the cap 15 is advanced (or elevated) from a retracted (lowered) position shown in FIG. 12(*a*) to seal the ejection outlet surface 21 as shown in FIG. 12(*b*). Then, after the airtight contact is established, the suction pump 16 (FIG. 1) is operated to suction the ink out of the ejection orifices 22 while maintaining the airtightness. When the negative pressure within the cap 15 is almost entirely canceled by sucking out a predetermined amount of the ink, the carriage 2 is slightly displaced to the right as shown in FIG. 12(*c*), whereby the leak is established between the concavity of the cap 15 and the atmosphere. The other structures in this embodiment are practically the same as those in the first embodiment shown in FIGS. 1 to 9.

In the third embodiment shown in FIG. 12, the ink is sucked out while the cap 15 is sealing the ejection outlet surface 21 as shown in FIG. 12(*b*), and then, the carriage 2 is slightly displaced to the right of the figure. This movement deforms the cap 15 as shown in FIG. 12(*c*), whereby the gap 31 is created between the cap 15 and the ejection outlet surface 21, establishing the leak between the concavity of the cap 15 and the atmosphere. Then, the ink is sucked out by operating the suction pump 16 (FIG. 1) under the leaking condition shown in FIG. 12(*c*), whereby almost all of the residual ink on the ejection outlet surface 21 is eliminated as it is in the first embodiment. In this embodiment, the ejection outlet surface 21 and the contact surface of the cap 15 are angled with reference to the direction in which the carriage 2 is slightly displaced, which offers such an advantage that it takes less displacement of the carriage 2 than the first embodiment, to create the gap between the ejection outlet surface 21 and the cap, in other words, it is easier to create the gap.

Figure 13A:
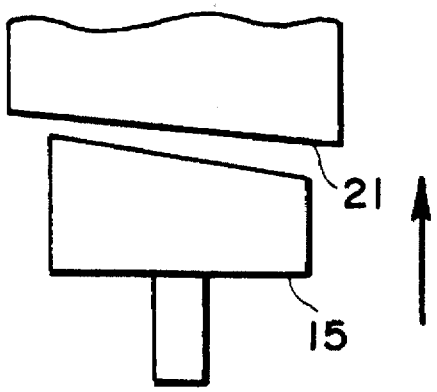
FIGS. 13(*a*)–(*c*) is a schematic drawing describing the cap leak operation in the third embodiment of the present invention.
Figure 13B:
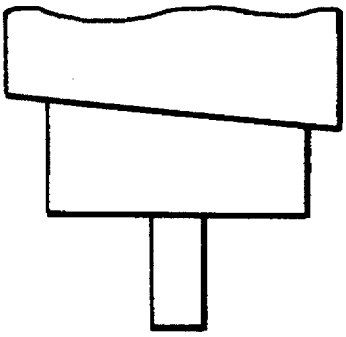
Figure 13C:
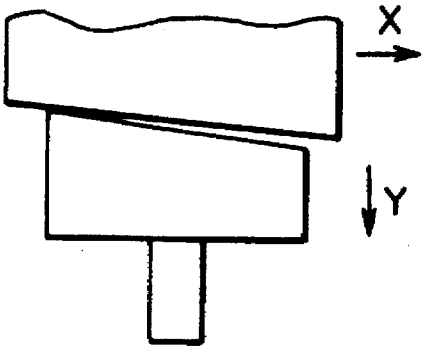

FIG. 13 shows a modified version of the third embodiment. In the original version of the third embodiment, the cap 15 is formed of the elastic material and the angle of its sealing surface is matched with the angle of the ejection outlet surface 21. However, in the modified version, the angle of the sealing surface of the cap 15 is slightly different from that of the ejection outlet surface 21. FIG. 13(*a*) shows the state in which the cap is off the ejection outlet surface 21, and the direction in which the cap 15 is elevated; FIG. 13(*b*) shows the state in which the cap 15 is sealing the ejection outlet surface 21 after it is elevated in the arrow direction in FIG. 12(*a*); and FIG. 13(*c*) shows the state in which the leak has been established either by slightly lowering the cap 15 in the arrow Y direction or by slightly moving the ejection outlet surface 21 in the arrow X direction. This presence of the slight angle difference between the sealing surface of the cap 15 and the ejection outlet surface 21 in this modified version makes it possible to from the gap between the ejection outlet surface 21 and the cap, either by more slightly lowering the cap 15 from the sealing position, or by more slightly displacing the ejection outlet surface 21 than in the original version than in the original version. Further, if both the cap and the ejection outlet surface 21 are slightly moved relative to each other, it is much easier to change the state of the compression contact between the sealing rim of the cap and the ejection outlet surface 21, and therefore, the leak can be more reliable controlled.

Figure 14A:
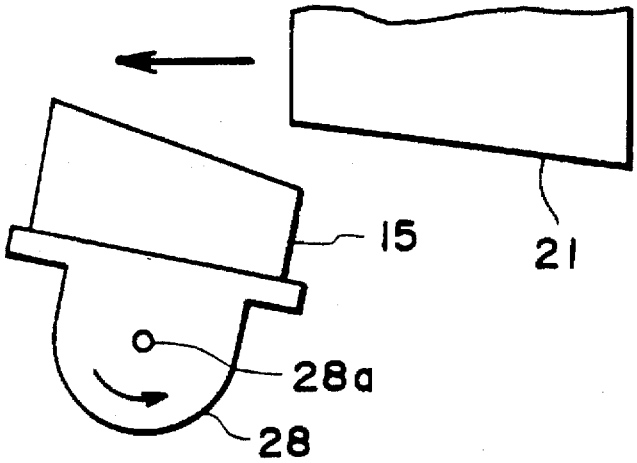
FIGS. 14(*a*)–(*c*) is a schematic drawing describing the cap leak operation in the second embodiment of the present invention.
Figure 14B:
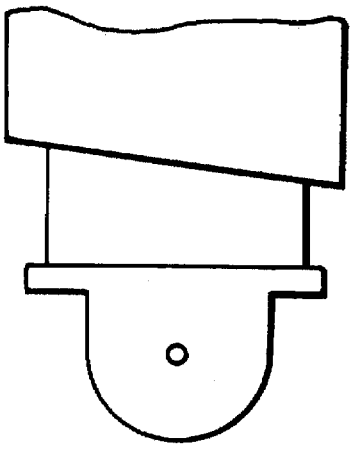
Figure 14C:
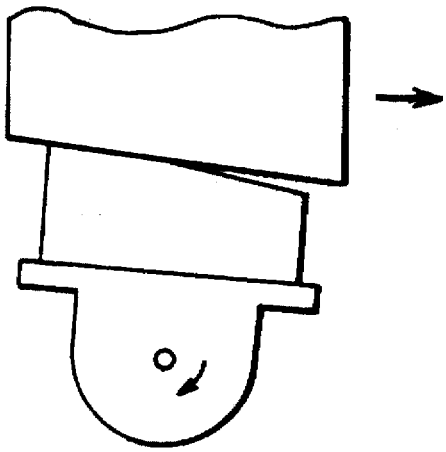

FIG. 14 shows the fourth embodiment, in which a unique capping method is taken. In FIG. 14(*a*), the recording head 1 mounted on the carriage 2 has not reached the capping position: in FIG. 14(*b*), the carriage 2 has reached the capping position and the capping has been completed; and in FIG. 14(*c*), the carriage 2 is being slightly displaced from the capping position, establishing the leak. A reference numeral in FIG. 14(*a*) designates a cap holder which is rotatable about an axis 28*a*. When the ejection outlet surface 21 is away from the cap as shown in FIG. 14(*a*), the cap 15 is held at an angle. As the carriage 2 is advanced toward the home position, the cap 15 comes in contact with the ejection outlet surface 21, whereby it is rotated in the counterclockwise direction while remaining in contact with the ejection outlet surface 21, and reaches the capping position as shown in FIG. 14(*b*). As for the absorbency recovery operation, the ink is sucked from the ejection orifices 22 by operating the suction pump 16 connected to the cap 15 under the condition shown in FIG. 14(*b*). When the negative pressure within the cap 15 is almost entirely canceled after a certain amount of the ink is sucked out, the carriage 2 is slightly displaced to the right of the figure, whereby the cap 15 is slightly rotated in the counterclockwise direction about the axis 28*a* of the cap holder 28, creating the gap between itself and the ejection outlet surface 21. Under this condition, the suction pump 16 is restarted, whereby almost all of the ink on the ejection outlet surface 21 and within the cap 15 can be removed. In this embodiment, the cap 15 is rotated by the movement of the carriage 2. However, the cap may be directly driven in coordination with the movement of the carriage 2. Thus, the structure in this embodiment allows a better control of the deformation of cap 15 and the moving directions of the cap and the ejection outlet surface 21 during their slight movements, and therefore, it can more reliably control the leak.

According to the above described embodiments 1 to 4 comprising: the wiping means 18 which wipes away the foreign matter adhering to the ejection outlet surface 21 as it moves, relative to the movement of the ejection outlet surface 21, while being pressed against the ejection outlet surface 21 of the recording head 1; the cleaning means 19 which is positioned next to the ejection outlet surface 21, with its upper surface being substantially level with the ejection outlet surface 21, cleaning thereby the wiping means 18 as it moves, relative to the movement of the wiping means 18, while being pressed against the wiping means 18; and the sucking means 16 for forcefully sucking the ink from the ejection orifices 22, the airtight contact established by the cap 15 is caused to break, in other words, the cap 15 is caused to leak while the ink is sucked out, whereby the residual ink on the ejection outlet surface 21 is reduced to the absolute minimum after the absorbency recovery operation. Therefore, the loads imparted on the wiping means 18 and the cleaning means 19 are reduced, prolonging their service lives. In other words, the ink jet recording apparatus according to the present invention can sustain the ink ejection performance, offering thereby excellent image quality, over a long period. Further, such a nuisance that the direction of ink ejection is shifted by the waste ink adhering to the ejection outlet surface 21, degrading thereby the image quality, in other words, the nuisance originating from using liquid ink as the recording agent, is prevented over a long period. Therefore, it is possible to provide an ink jet recording apparatus capable of sustaining the performance to produce an excellent height quality image.

Figure 15:
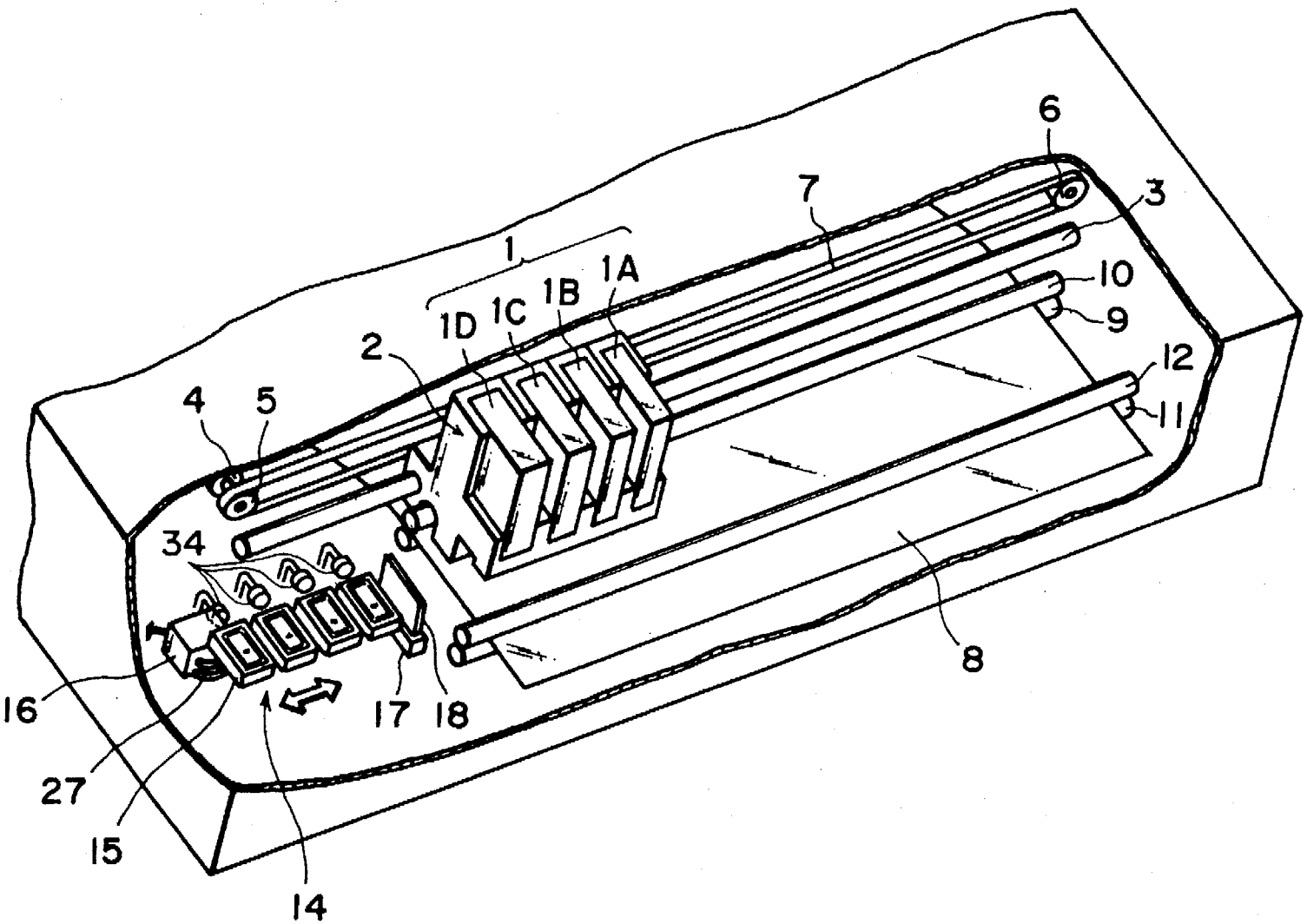
FIG. 15 is a partially cut out schematic perspective view of the ink jet recording apparatus in accordance with the present invention, depicting the essential structure of the fifth embodiment of the present invention.

FIG. 15 is a schematic perspective view of an ink jet recording apparatus to which the present invention has been applied, depicting the essential structure of the fifth embodiment of the present invention. In this embodiment, an air passage communicating with (opening to) the ejection outlet surface 21 is provided in each of the recording heads 1. In the vicinity of the capping unit (cap) 15 of the recording apparatus, a valve 4 for opening or closing the air passage (at the other end of the passage) is provided; one for each of the recording heads 1, that is, a total of four are provided, as shown in FIG. 15. The valve 4 is driven with a predetermined timing by an unshown cam mechanism to be placed in contact with (closing) or to be moved away (opening) from the opening of the air passage of the recording head 1, that is, the opening opposite to the ejection outlet surface 21. With provision of the air passage in the recording head 1 and the auxiliary mechanism, the concavity of the cap 15 can be reliably sealed or unsealed, without restricting the choice of the cap material, and therefore, it is not necessary to increase the amount of suction.

Figure 16A:
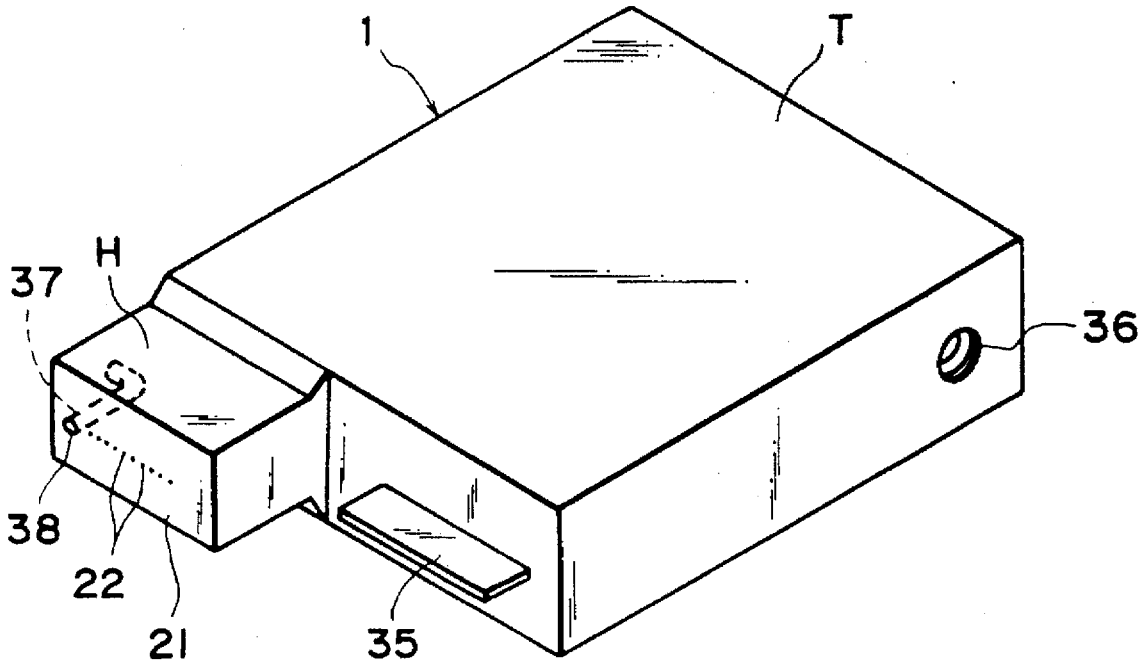
FIG. 16(*a*) is a perspective view of the recording means shown in FIG. 15, and FIG. 16(*b*) is a plan view of the bottom of the carriage shown in FIG. 15.
Figure 16B:
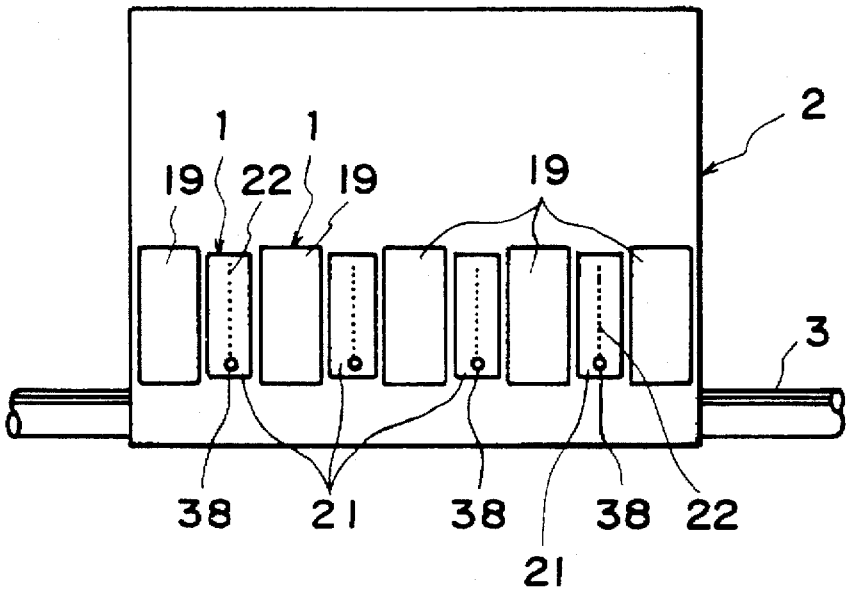
Figure 17A:
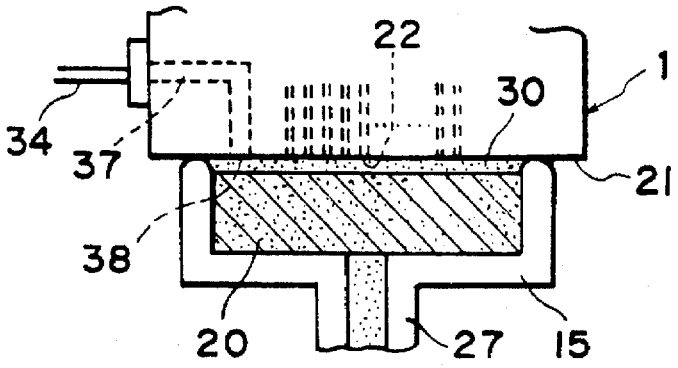
FIGS. 17(*a*), 17(*b*), 17(*c*) and 17(*d*) are schematic sectional drawings, depicting the absorbency recovery operation in the fifth embodiment of the present invention.
Figure 17B:
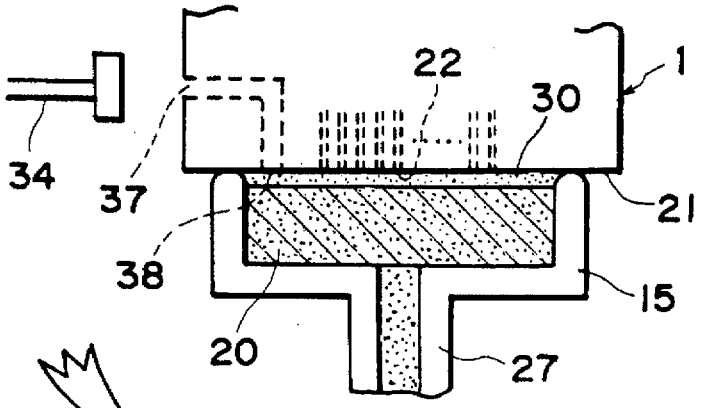
Figure 17C:
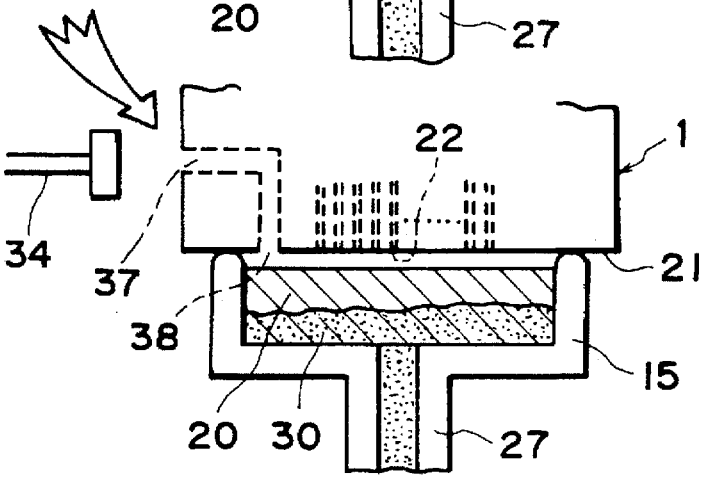
Figure 17D:
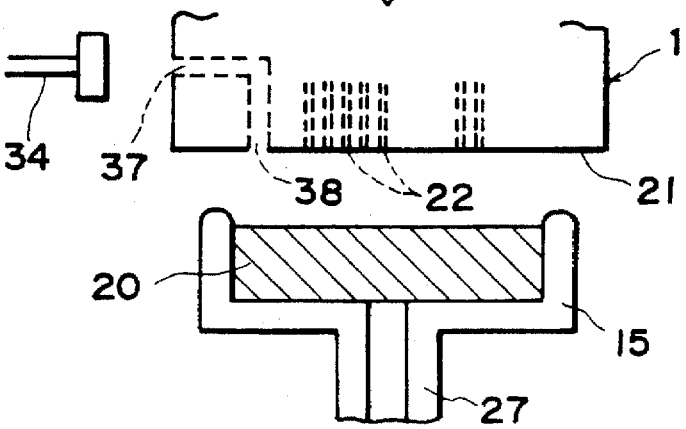

FIG. 16 show the recording head 1 (head cartridge) and the carriage 2 of the recording apparatus shown in FIG. 15; FIG. 16(*a*) is a perspective view of the recording head 1, and FIG. 16(*b*) is a plan view of the carriage 2, as soon from the bottom, which is correspondent with FIG. 3. In FIG. 16(*a*), the recording head 1 is an exchangeable combination head comprising a recording head member H and an ink container T. One of the end surfaces of the recording head H serves as the ejection outlet surface 21 where two or more ejection orifices 22 are present. A reference numeral 35 designates a connector to receive signals for driving the recording head 1, and a reference numeral 36 designates an air vent of the ink container T. In this embodiment, the recording head 1 is provided with an air passage 37 communicating with (opening at) the ejection outlet surface 21. The cross-sectional area of this air passage 37 is preferred to be larger than that of the ejection orifice 22, so that flow resistance becomes small enough to prevent the ink from remaining in the air passage 37. Referring to FIG. 16(*b*), on the bottom surface of the carriage 2, the ink absorbing members 19 as the cleaning means (blade cleaner) for cleaning the blade 18 are fixed in such a manner as to sandwich the ejection outlet surface 21 of the recording head 1, in the same manner as is shown in FIG. 3. The air passage 37 opens at the ejection outlet surface 21, and the location of this opening 38 of the air passage 37 is selected so as for the opening 38 to fall within the boundary of the cap 15 when the cap is sealing the ejection outlet surface 21. The structure of this embodiments is different from those in the first embodiment shown in FIGS. 1 to 9, in that the valve 34 and air passage 37 are provided, but otherwise, it has practically the same structure. Therefore, the corresponding components are designated by the same reference codes, and their detailed descriptions are omitted.

FIG. 17 is a schematic drawing for describing the ink sucking operation in this embodiment (fifth embodiment). The porous ink absorbing member 20 is placed within the concavity of the cap 15, filling the cap 15 almost to the rim so that the ink absorbing member 20 will be positioned extremely close to the ejection outlet surface 21 when the cap 15 is airtightly placed on the ejection outlet surface 21. The densely hatched area 30 represents the ink sucked from the ejection orifice 22. In the ink sucking operation of this embodiment, first, the air passage 37 communicating with the ejection outlet surface 21 is closed at the shutoff valve 34. Next, the cap 15 seals the ejection outlet surface 21. Then, the negative pressure is generated by the suction pump 16 (FIG. 15), whereby the ink is sucked from the ejection orifice 22. Then, the suction pump 16 is temporarily stopped; FIG. 17(*a*) shows the state of this moment. In the case of this embodiment, when the cap is airtightly placed on the ejection outlet surface 21, the opening 38 of the air passage 37 is covered (sealed) along with the ejection orifices 22. In the state shown in FIG. 17(*a*), the negative pressure, which is still present after the suction pump 16 is stopped, has been almost completely canceled as a given amount of the ink is sucked out, in other words, the negative pressure has been reduced to a point where the meniscus at the ejection orifice 22 begins to hold.

Figure 20A:
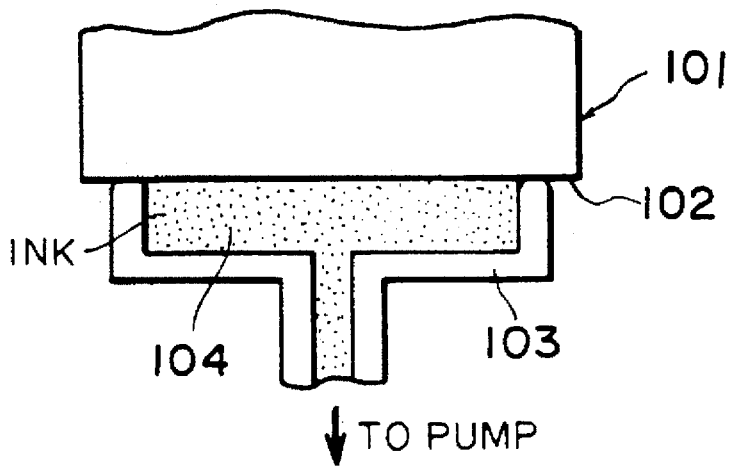
FIG. 20(a) PRIOR ART
FIGS. 20(*a*), 20(*b*) and 20(*c*) are schematic sectional drawings, describing the absorbency recovery operation in a conventional ink jet recording apparatus.
Figure 20B:
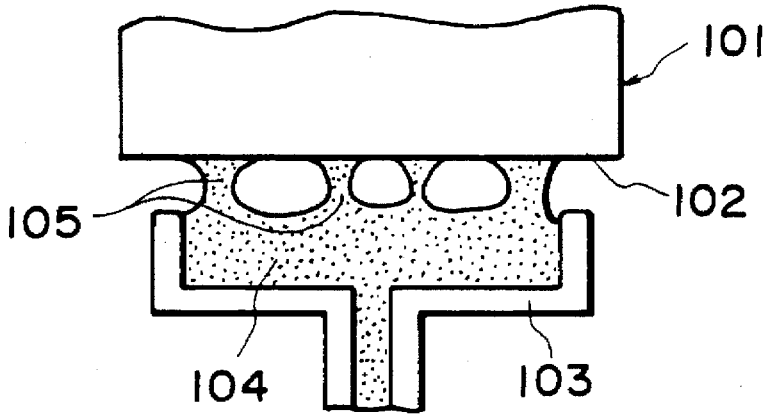
FIG. 20(b) PRIOR ART
Figure 20C:
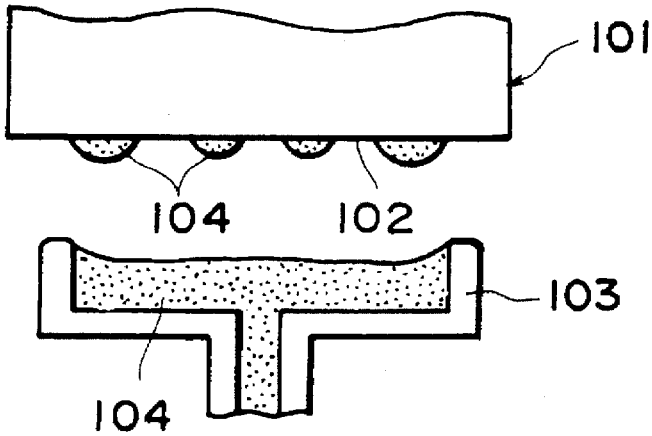
FIG. 20(c) PRIOR ART

If the cap 15 is pulled away when the negative pressure is still high, the atmospheric pressure is suddenly imparted within the concavity of the cap 15, and it is possible for this sudden pressure change to break the meniscus at the ejection orifice 22, whereby the air may enter through the ejection orifice 22, causing the faulting ejection. This problem is the same as that in the first embodiment. Under the condition shown in FIG. 17(*a*), the cap 15 is almost entirely filled with the ink, in other words, the ink absorbing member 20 is almost saturated with the ink, losing its ink absorbing capacity. If the cap 15 is pulled away under this condition, a large amount of the ink remains on the ejection outlet surface 21 in the same manner as shown in FIG. 20. Therefore, the following procedure is adopted in this embodiment.

That is, starting from the state shown in FIG. 17(*a*), the shutoff valve 34 which has been sealing the air passage 37 is pulled off, whereby connection is established between the concavity of the cap 15 and the atmosphere, with the cap 15 still holding the airtight contact with the ejection outlet surface 21, as shown in FIG. 17(*b*). Under this condition, the suction pump 16 (FIG. 15) is restarted as shown in FIG. 17(*c*). Under the condition shown in FIG. 17(*c*), the concavity of the cap 15 is connected to the atmosphere through the air passage 37, that is, the cap 15 is under the leak (open) condition, and since the flow resistance of the air passage 37 is smaller than that of the ejection orifice 22, only the ink within the cap 15 is sucked by the suction pump 16 through the tube 27, with no ink being sucked out of the ejection orifices 22, whereby the porous ink absorbing member 20 placed in the cap 15 recovers its full ink absorbing capacity. Further, this renewed porous ink absorbing member 20 is still placed so close to the ejection outlet surface 21 that almost all of the ink left on the ejection outlet surface 21 is absorbed by this ink absorbing member 20, boasting now its full ink absorbing capacity.

After even the ink to be otherwise left on the ejection outlet surface 21 is absorbed in the ink absorbing member 20, and then, is sucked away by the suction pump 16, the cap 15 is separated from the ejection outlet surface 21. Therefore, the absorbency recovery operation is completed leaving hardly any ink on the ejection outlet surface 21. At this time, the second sucking operation by the suction pump 16 is stopped after the ink within the ink absorbing member 20 is sufficiently emptied by sucking. Because of the described structure and operation, the absorbency recovery operations is completed, leaving hardly any ink on the ejection outlet surface 21. With hardly any ink being left on the ejection outlet surface 21 after the sucking the ink through the ejection orifices 22, the loads imparted on the blade 18 and ink absorbing member 19 (blade cleaner) during the wiping operation by the blade 18 can be greatly reduced.

FIG. 18 is a schematic drawing for describing a preferable positional relation between the air passage 37 of the recording head 1 and the suction opening 39 (opening leading to the tube 27) of the cap 15. From the standpoint of the performance to suck effectively the ink throughout the concavity of the cap 15, it is preferable for the air passage 37 and the suction opening 39 to be positioned apart from each other as for as possible, as shown in FIG. 18. When the ejection outlet surface 21 remains capped while the apparatus is not in operation or on standby, the air passage 37 also remains closed by the shutoff valve 34 to prevent the ink from evaporating, so that the ink does not increase its viscosity at the ejection orifices 22; does no dry up there; and does not dry up and stick there. Further, if the air passage is located close to the ejection orifices 22, the ink can be sucked from the proximity of the ejection orifices 22, which can more reliably prevent the ink from adhering to the ejection outlet surface 21.

Hereinbelow, another endurance test is described, which was conducted to confirm the effects of the absorbency recovery operations in the fifth embodiment shown in FIGS. 15 to 18, under the same conditions as the first embodiment. In this test, the blade 18 was 0.7 mm thick, 12.0 mm wide, and 8.0 mm long, and the margin of the blade protrusion toward the ejection outlet surface 21 during the wiping operation was 1.5 mm. The moving speed of the carriage 2 during the wiping operation was 200 mm/sec. The recording head 1 used for this test had 128 ejection orifices and its resolution was 400 dpi. The absorbency recovery and wiping operations were carried out each time an A4 size recording material was finished. The amount of the slight displacement of the carriage 2 for shifting the cap 15 during the absorbency recovery operation was 0.4 mm. As for the test environment, the temperature was set at 35° C., and the humidity was set at 80% to 90%, being hot and humid. In other words, a sever environmental condition was set in which the amount of ejected ink was large, with more ink adhering to the ejection outlet surface 21, and in addition, the ink was difficult to dry.

The recording was made at a recording ratio of 100%, that is, a solid black recording, increasing thereby the amount of adhering ink to the maximum. While 5000 pieces of A4 size recording material were fed for the endurance test, no faulty ejection such as shifting or no ejection was observed. Another endurance test was conducted for comparison, in which the air passage 37 of the recording head 1 and the shutoff valve 34 were eliminated. During this comparison test, the faulty ejections or color mixing occurred after 1000 pieces or so were recorded. These tests proved that the service life of the ink jet recording apparatus comprising the blade 18 and blade cleaner 19 could be immensely improved in terms of sheet count, by providing the recording head 1 with the air passage 37 and the shutoff valve 34.

In this embodiment, four recording head 1 (head cartridges) as shown in FIG. 9 are used for color recording, but the number of the recording head is not limited to four. It may be one or another number beside one. This embodiment also solves a problem peculiar to the color recording, that is, the color mixing, and therefore, it is extremely effective when applied to a color recording apparatus.

Figure 19:
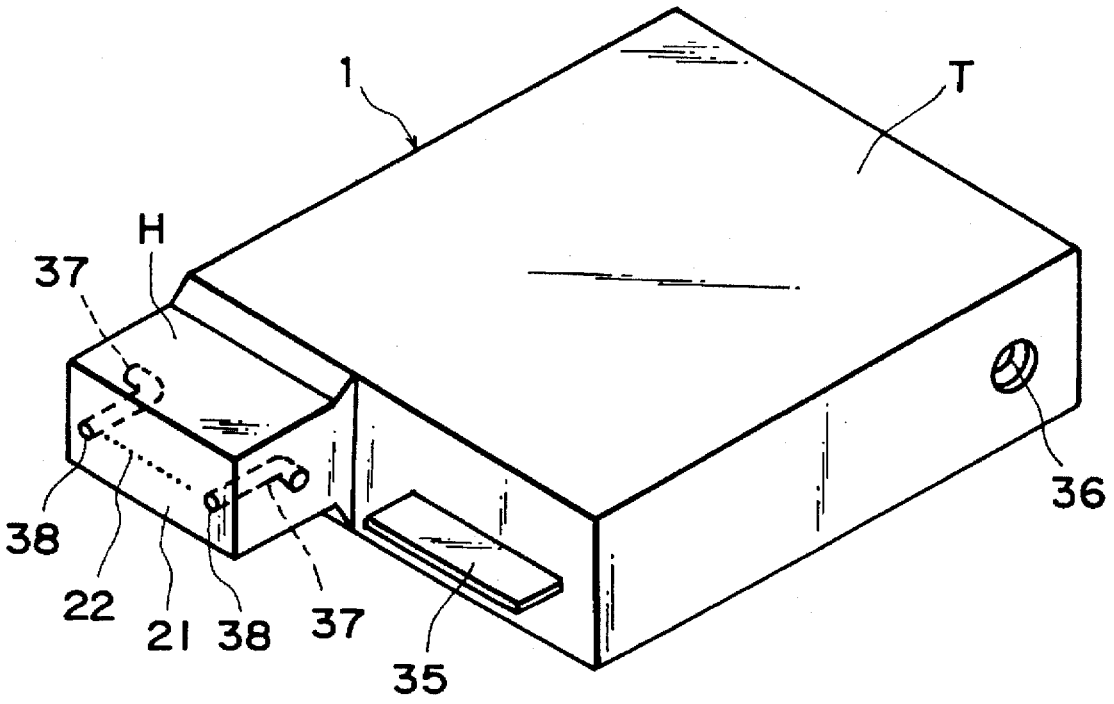
FIG. 19 is a schematic perspective view of the recording means in the sixth embodiment of the present invention.

FIG. 19 is a schematic perspective view of a recording head of an ink jet recording head according to the present invention, describing the sixth embodiment of the present invention. In this embodiment, the air passage 37 opening at the ejection outlet surface 21 is provided at two locations, in other words, the opening 38 of the air passage 37 on the ejection outlet surface 21 is located at both ends of the column of the ejection orifices 22. The other structure of this embodiment is practically the same as the fifth embodiment shown in FIGS. 15 to 18. According to this embodiment, the ink left otherwise on the ejection outlet surface 21 during the absorbency recovery operation is almost entirely eliminated. Since the air passage 37 is provided at both ends of the ejection outlet surface 21, this embodiment offers not only the same effects as the aforementioned fourth embodiment, with an added air intake efficiency, but also other effects, such that even if one of the air passages 37 is clogged, the air can still be taken in through the other air passage 37, further assuring the removal of the ink. As will be evident from the structure shown in FIG. 19, the air passage 37 of the recording head I may be provided at three or more locations, wherein the number or locational arrangement of the openings 38 with reference to the column of the ejection orifices 22 is not limited to the one shown in the drawing, and may be optionally determined.

According to the above described embodiments 5 and 6 comprising: the wiping means 18 which wipes away the foreign matters adhering to the ejection outlet surface 21 as it moves, relative to the movement of the ejection outlet surface 21, while being pressed against the ejection outlet surface 21 of the recording head 1; the cleaning means 19 which is positioned next to the ejection outlet surface 21, with its upper surface being substantially level with the ejection outlet surface 21, cleaning thereby the wiping means 18 as it moves, relative to the movement of the wiping means 18, while being pressed against the wiping means 18; the sucking means 16 for forcefully sucking the ink from the ejection orifices 22; the air passage 37 communication with the ejection outlet surface 21 of the recording head 1; and the shutoff means 34 for opening or closing the air passage 37, the residual ink on the ejection outlet surface 21 is eliminated after the sucking operation for recovering the performance of the ejection outlet 21 of the recording head 1. Therefore, loads imparted on the wiping means 18 and the cleaning means 19 are reduced, prolonging their service lives. In other words, the ink jet recording apparatus according to the present invention can sustain the ink ejection performance, offering thereby excellent image quality, over a long period. Further, such a nuisance that the direction of ink ejection is shifted by the waste ink adhering to the ejection outlet surface 21, degrading thereby he image quality, in other words, the nuisance originating from using liquid ink as the recording agent, is prevented over a long period. Therefore, it is possible to provide an ink jet recording apparatus capable of sustaining the performance to produce an excellent high quality image. Further, since the internal volume of the cap 15 can be reduced, in other words, the size of the cap 15 can be reduced, to match the small head cartridge 1, the amount of the ink to be sucked out can be minimized, reducing thereby the amount of the waste ink.

FIG. 21 is a schematic perspective view of an ink jet recording apparatus according to the present invention, describing the seventh embodiment of the present invention. In FIG. 21, two or more (four) exchangeable head cartridges 1A, 1B, 1C, and 1D are mounted on the carriage 2. Each of the head cartridges 1A to 1D has an ink container, at the top, and a recording head (ink ejecting member), at the bottom. In this embodiment, the recording means (recording heads) 1A to 1D are the combination head cartridges in which the recording head and ink container are combined. The recording data are transmitted to the recording heads 1A to 1D, from the electrical circuit of the main assembly of the apparatus through a cable 51. In the following description, the term, "recording means 1 (recording head or recording cartridge)," designates either all of the recording means 1A to 1D, or any one of them.

The two or more recording heads 1 in this embodiment are devices for ejecting ink from two or more ejection orifices 22 to form micro dots on the recording material 8, comprising thereby images. Each of the ink ejecting members of the recording head 1 have the same structure as that in FIG. 2. Ink of different color (or different density) is ejected from each of different recording heads 1, and the proper mixture of the ink droplets forms color images on the recording material 8. As for colors used in the different recording heads 1 for color recording, they are such colors as black, cyan, magenta, and yellow. These exchangeable recording heads 1 are mounted on the carriage 2 to hold a specific positional relation. The color inks are ejected in the aforementioned order while the carriage 2 is moved in the primary scanning direction.

For example, in order to create a red color, the magenta ink is first landed on the recording material 8 creating a magenta dot, and next, the yellow ink is landed on top of the magenta dot, creating a dot which looks red. In the same manner, other desired colors are also created by combinations of these inks; green is from cyan and yellow inks, and blue from cyan and magenta inks, landed in these orders to form a dot of the desired color. Here, each recording head 1 is positioned with a predetermined interval (P1) from the adjacent ones. Therefore, for instance, when solid green color is wanted, the recording of the yellow color is delayed by twice the aforementioned interval (2×P1) after the recording of the cyan color begins, in other words, the solid yellow color is recorded on top of the solid cyan color.

The carriage 2 movement is the primary scanning direction is controlled in response to the scanning speed and recording location of the carriage 2 deleted by a speed detecting means (unshown). The carriage 2 is driven by the carriage driving motor 5 through the timing belt, whereby the carriage 2 shuttles along the guide shaft 54 extended in the primary scanning direction of the carriage 2 recording is made in a horizontal line (belt) while the carriage 2 is moved in the primary scanning direction. There are two types in the horizontal recording; unidirectional and bidirectional recordings. Generally speaking, in the unidirectional recording, recording is made only when the carriage 2 is moving from the home position set up on one side of the apparatus to the opposite side (forward movement), and is not made while the carriage 2 is returning to the home position. Therefore, the unidirectional recording can produce images of high precision. Contrarily, in the bidirectional recording, recording is made in both forward and backward directions, and therefore, it can record at high speed.

In FIG. 21, a recovery unit 55 is located at a side location (left end in the drawing) which is within the moving range of the carriage 2, but is off the passageway of the recording material. This recovery unit 55 is provided for maintaining the performance of the recording head 1, or recovering the performance of the recording head 1 when the faulty ink ejection occurs. Also, it has a cap unit 56. In the embodiment shown in the drawing, there are four recording heads, and accordingly, there are four caps 56. The cap 56 is pressed on the ejection outlet surface 21 to seal the ejection orifices 22, and it is used not only for recovering the performance for the recording head 1, but also for preventing the ink in the ejection orifices 22 from drying or the like, during the non-recording period. Therefore, the position where the carriage 2 (hence, recording unit 1) faces the performance recovery unit 55 is called the home position.

Hereinafter, the function of the recovery unit 55 during the actual recording operation is concretely described. During the actual recording operation, it is not always that all of the ejection orifices in a single recording head 1 are activated. Also, in an apparatus comprising two or more recording heads 1, there are some recording heads to which recording date are not sent, in other words, some recording heads are not used. While the carriage is moved (while the recording head 1 is not capped), if the ink is not ejected from a certain ejection orifice 22 for a given period, the ink adhering around the ejection orifices 22 on the ejection outlet surface 21 dries up and sticks there. As a result, the ink ejection performance of this orifice declines, resulting in the inferior image quality. In order to maintain the normal condition of the ejection orifices 22 and the ejection outlet surface 21 by preventing such a phenomenon, the ink is ejected with given intervals, in addition to being ejected in response to the recording data. Such an extra ink ejecting operation besides the ejection for actual recording is called preliminary ejection.

As for the preliminary ejection, in order to prevent the recording material 8 or the interior of the apparatus from being soiled by the ink splash, and ink catcher must be provided, wherein the ink is ejected toward the ink catcher, with the recording head 1 directly facing the ink catcher.

In FIG. 21, the recording material 8 is conveyed in the secondary scanning direction by a conveying member such as rubber rollers being driven by an unshown sheet feeding motor. The recording material 8 is fed from the side indicated by an arrow A. As the recording material 8 is delivered to the recording position by the conveying member, recording begins to be made on the recording material 8 by the recording head 1. The recording material 8 on which recording has been made is discharged in the direction indicated by an arrow B by a discharging mechanism comprising a sheet discharging roller 57 or the like. As to the ink supply to the recording head 1, each of the recording heads 1 is supplied with one of the inks of different colors stored in different ink containers.

When color images are recorded, various factors such as color development, gradation, and uniformity are involved. This is different from when only characters are recorded using the monochrome recording mode. In particular, the uniformity is easily affected. Even a slight difference in a single ejection orifice which may occur during the manufacturing process of the recording head 1 adversely effects the amount or direction of the ink ejected from each of the ejection orifices 22 during the recording operation, and ultimately causes deterioration of image quality such as uneven recording density over the recorded images.

Figure 23C:
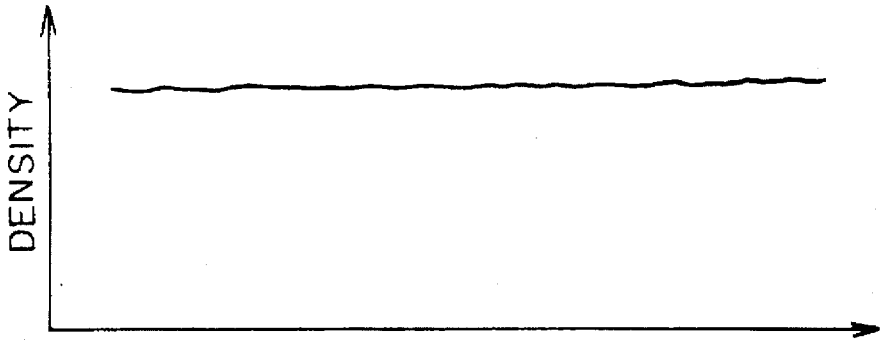
FIGS. 23(*a*), 23(*b*) and 23(*c*) are drawings presenting an idealistic condition of the ink jet recording.
Figure 23B:
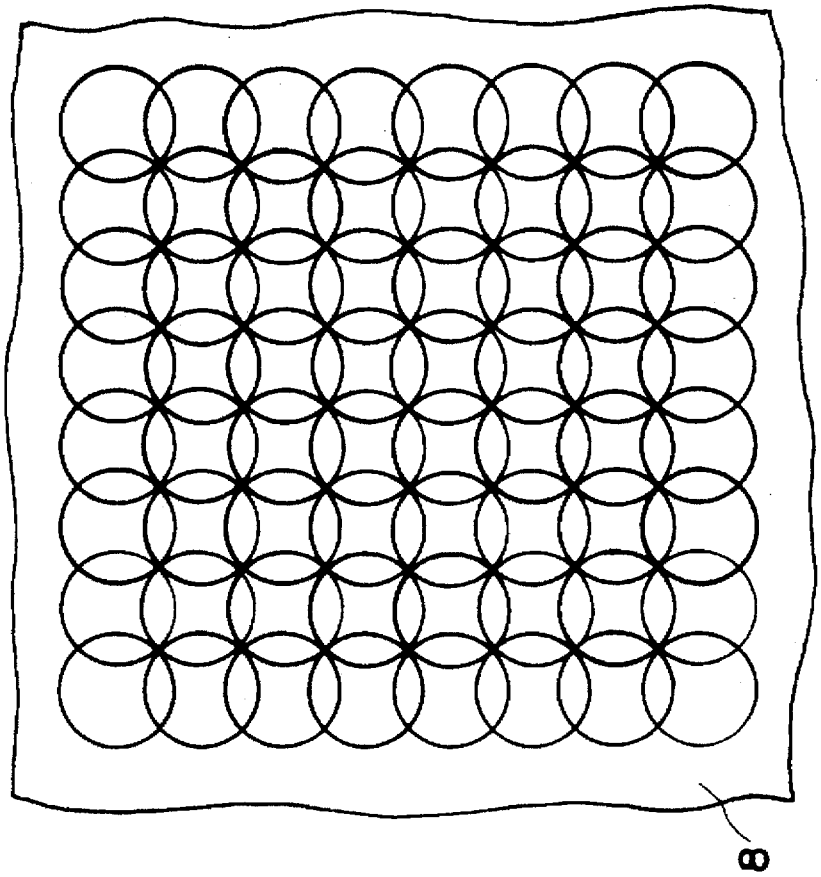
Figure 23A:
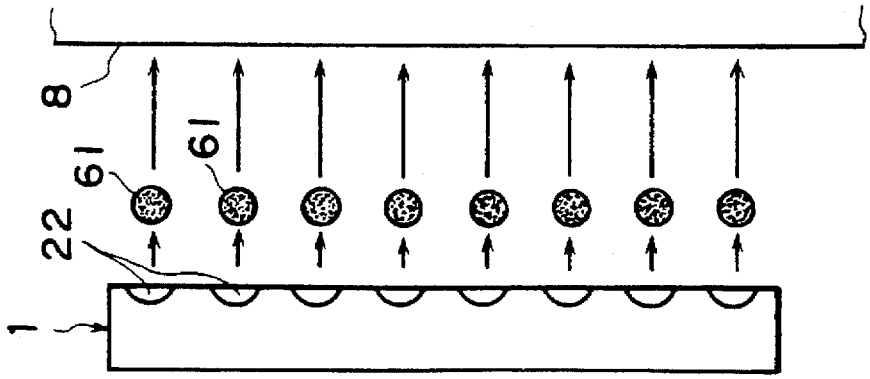
Figure 24C:
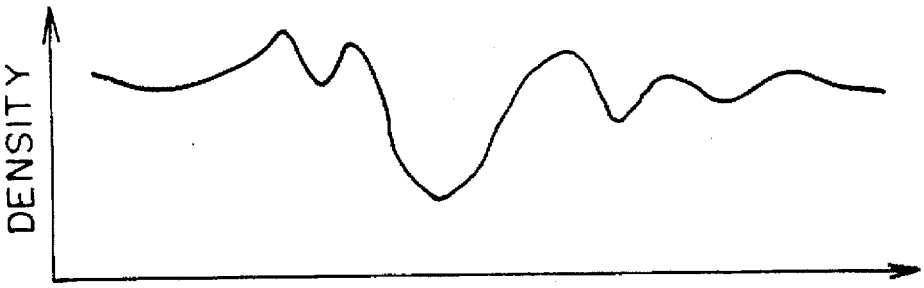
FIGS. 24(*a*), 24(*b*) and 24(*c*) are drawings presenting an actual condition of the ink jet recording.
Figure 24B:
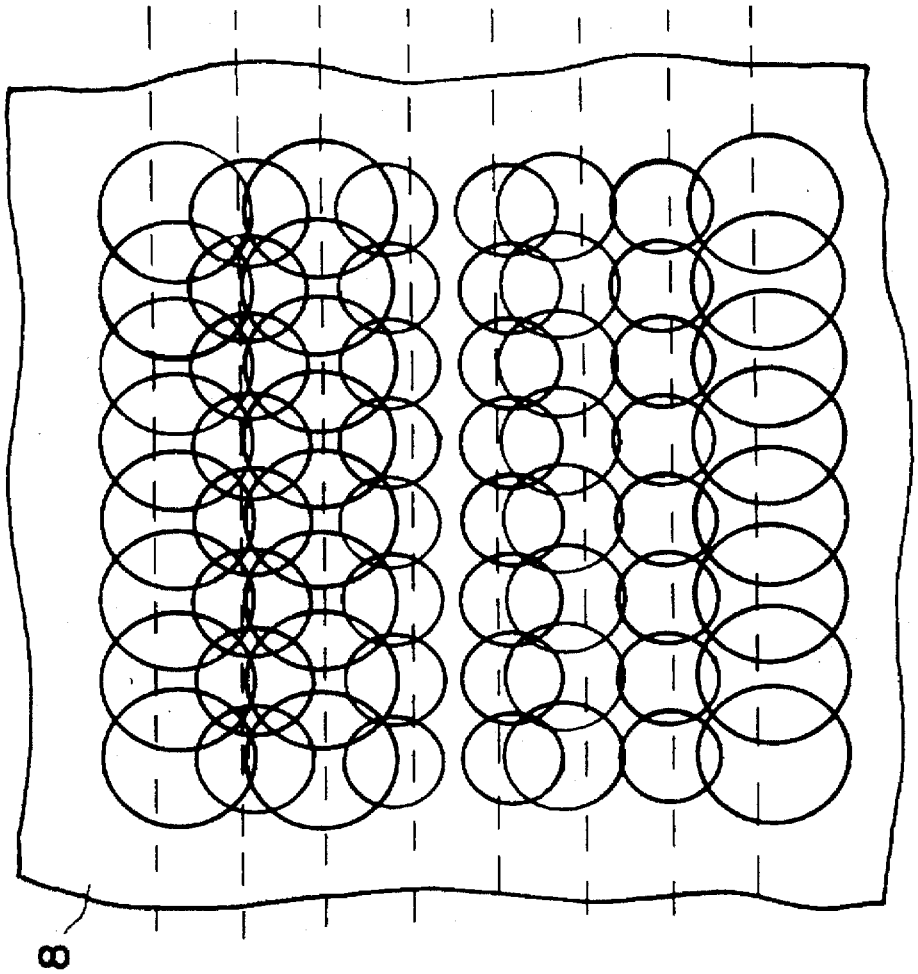
Figure 24A:
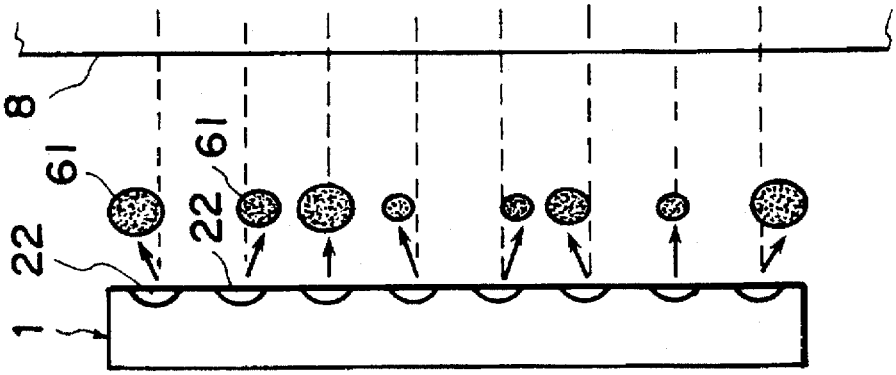

Hereinafter, a concrete example of the uneven recording density is described. For the sake of simplicity, the description refers to a monochrome recording head. FIGS. 23 and 24 are schematic drawings for depicting the dot formations for the fine mode of a recording system. Here again, for the sake of simplicity, FIGS. 23 and 24 show a case in which the recording head has eight ejection orifices aligned straight. Referring to FIG. 23(*a*), ink droplets 61 are ejected from the ejection orifices 22 of the recording head toward the recording material 8. Under the normal condition, the ink droplets 61 composed of the same amount of the ink are ejected in the same direction, as shown in FIG. 23(*a*), which constitutes an idealistic ejection. When such an idealistic ejection occurs, dots of an equal size are landed on precise locations of the recording material 8, as shown in FIG. 23(*b*), whereby images are recorded with no uneven recording density over the entire recording material 8, as shown in FIG. 23(*c*).

However, in the actual situation, the ejection orifices 22 are different from each other as was described hereinbefore. Therefore, if recording is made in the same manner as shown in FIG. 23, the sizes and directions of the ink droplets 61 ejected from the ejection orifices 22 become different from each other, whereby the ink droplets 61 unevenly land on the recording surface of the recording material 8 as shown in FIG. 24(*b*). In the example shown in FIG. 24, white areas periodically appear in the primary scanning direction of the recording head 1, at the points where an area factor of 100% is not satisfied; an unnecessary number of dots are superimposed on each other; and a white band appears as seen in the middle of FIG. 24(*b*). The formation of the dots made by such uneven landing of the ink droplets displays a density distribution as shown in FIG. 24(*c*), in the direction in which the ejection orifices 22 are aligned. Ultimately, this phenomenon is perceived as the uneven recording density as far as eyesight of a normal person is concerned. Further, there sometimes appear streaks caused by instable delivery of the recording material 8.

As a measure for preventing such recording density irregularity or streaks, Laid-Open Japanese Patent Application No. 107,975/1985 discloses the following method, which pertains to the monochrome recording head. The method is briefly described referring to FIGS. 25 and 26. In this method, the recording head 1 is made to scan the recording material 8 three times to finish recording the area shown in FIGS. 23 and 24. However, each horizontal half of the area, which corresponds to four dots width, is subjected to two scanning passes. In this case, the number of dots recorded by a single ejection orifice 22 during a single scan is half the number for the normal scanning, which corresponds to a half of the image data. In other words, every other data in a series of data is skipped during the first scanning pass, and the skipped data are used for inserting the rest of dots during the second scanning pass, to finish the horizontal half of the area, which correspond to four dots width. Such a recording system is called the fine recording system.

Figures 25A, 25B, 25C:
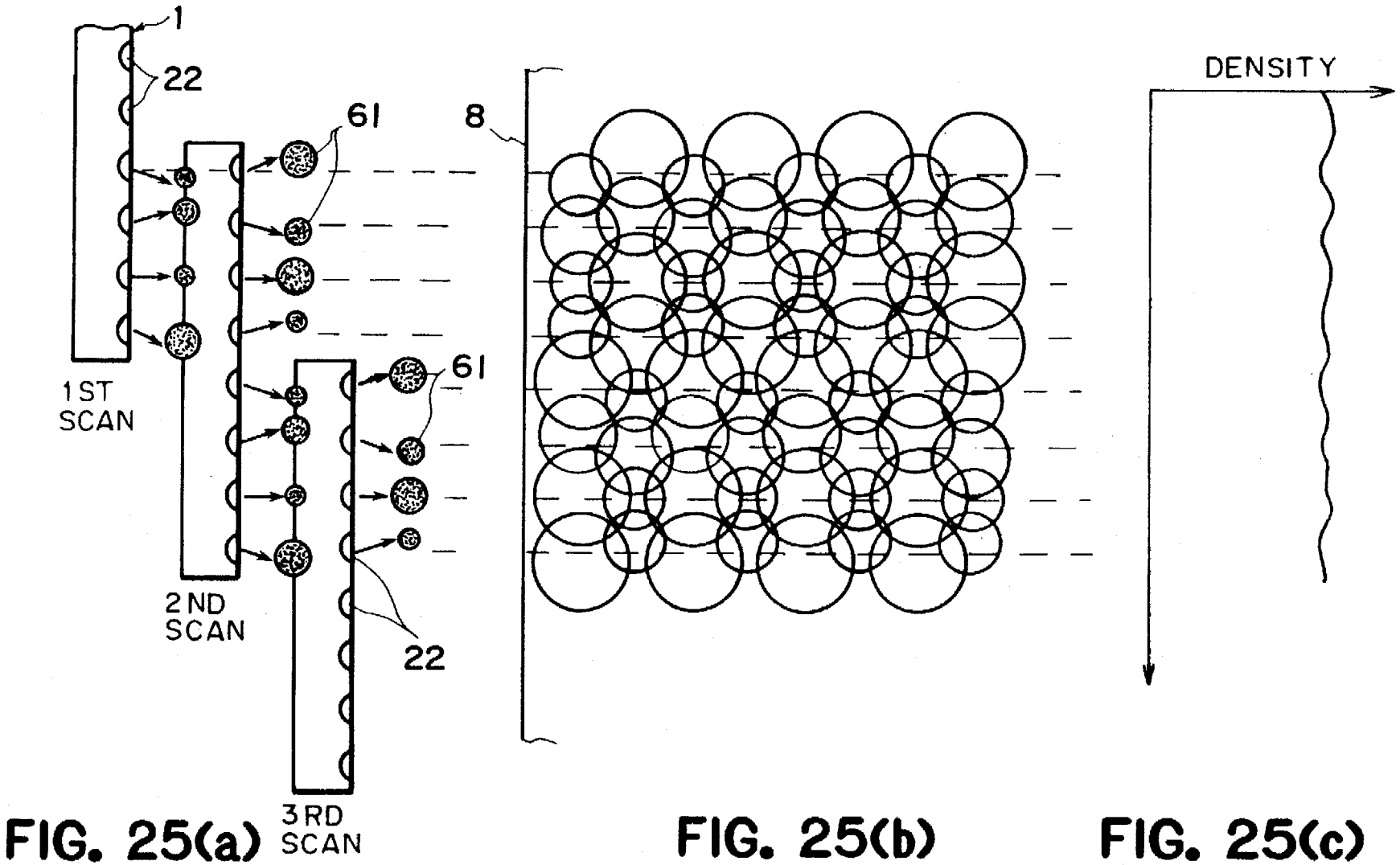
FIGS. 25(*a*), 25(*b*) and 25(*c*) are drawings presenting an actual condition of the ink jet recording in the fine mode.
Figure 26A:
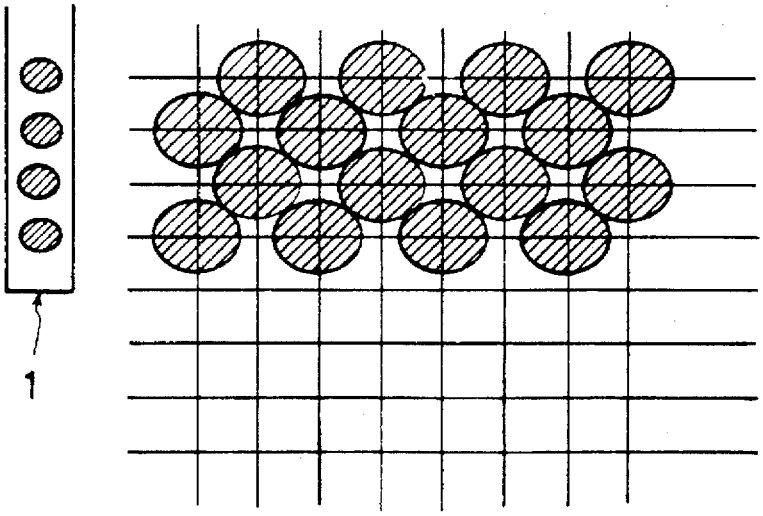
FIGS. 26(*a*), 26(*b*) and 26(*c*) present magnified appearances of a staggered pattern and a reversely staggered pattern.
Figure 26B:
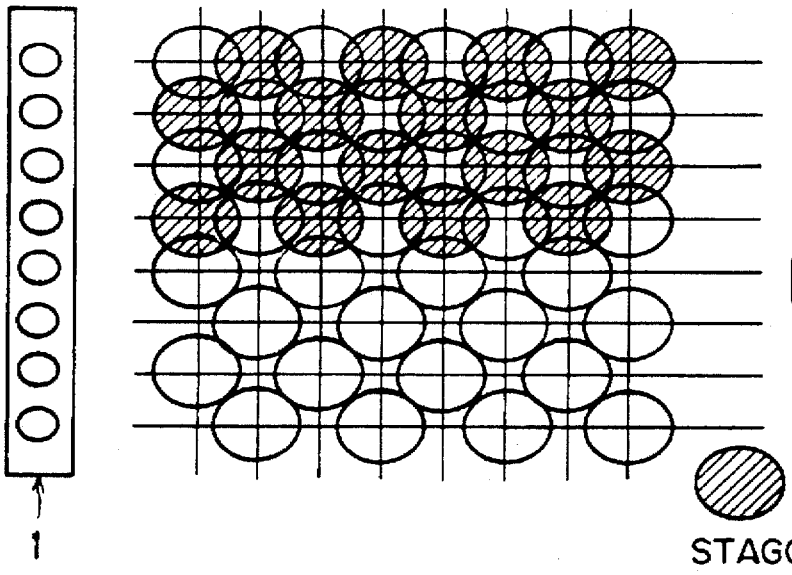
Figure 26C:
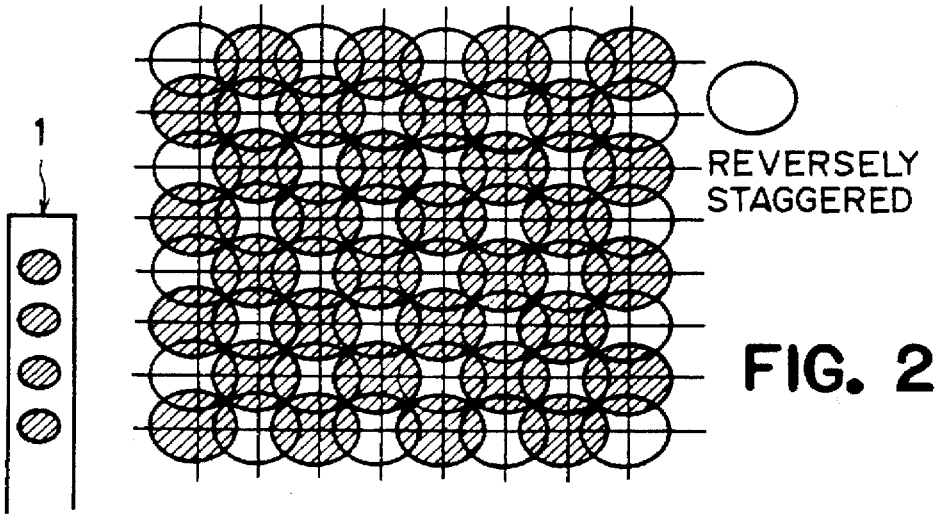
Figure 27A:
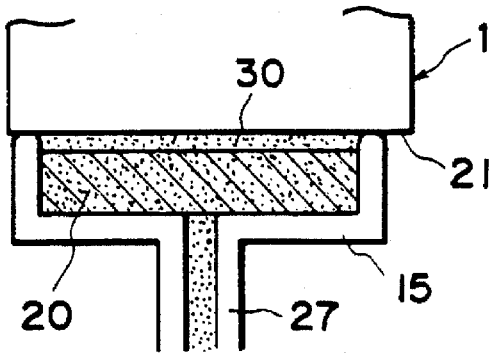
FIGS. 27(*a*)–(*d*) illustrates a device according to a first embodiment of the present invention.
Figure 27B:
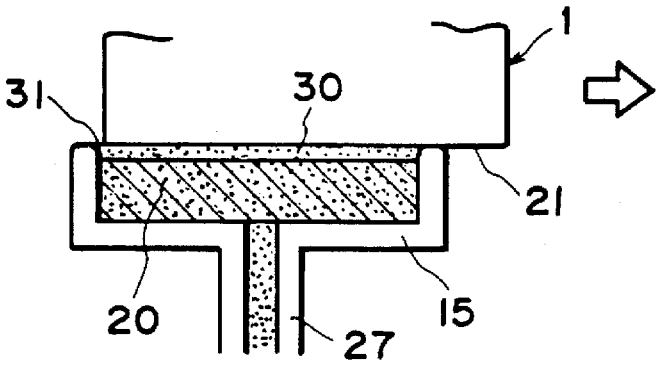
Figure 27C:
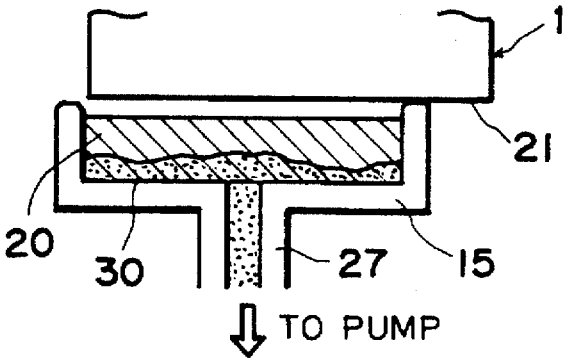
Figure 27D:
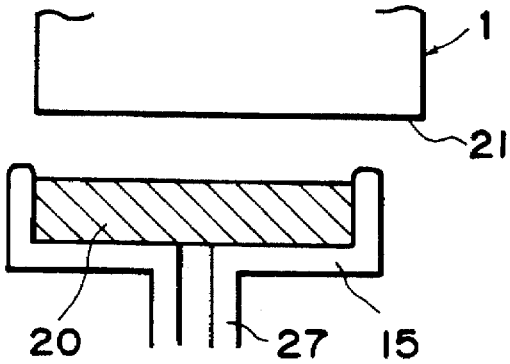

Use of the aforementioned fine recording system reduces the effect of individual ejection orifices 22 having a different ejection characteristic. Therefore, even when a recording head similar to the one shown in FIG. 24(*a*) is employed, the recorded image looks like FIG. 25(*b*), instead of looking like FIG. 24(*b*) in which a black or white streak stands out. Therefore, as is shown in FIG. 25(*b*), the recording density irregularity is substantially moderated in comparison to the irregularity shown in FIG. 24(*b*). During the recording operation using this recording system, the recording data are divided into two groups of data, one for the first scanning run and the other for the second scanning run, so that the corresponding dots are formed into a pattern capable of complementing itself between the first and second scanning runs, wherein, generally speaking, the image data are arranged (skipped) to create a dot pattern staggered both horizontally and vertically as shown in FIG. 26.

In other words, each of the horizontal halves (area corresponding to a unit of four ejection orifices) of the recording area which is ordinarily completed by a single scanning is completed by combination of the first scanning for recording the normal staggered pattern, and the second scanning for recording the reversal staggered pattern. FIGS. 26(*a*), 26(*b*) and 26(*c*) are drawings for describing how the recording of a given area is covered with the aforementioned normally and reversely staggered dot patterns, using a recording head 1 having the same number, that is, eight, of the ejection orifices 22 as the one shown in FIGS. 23 and 24. Referring to FIG. 26, during the first scanning, the staggered dot pattern is recorded using the bottom four ejection orifices 22 as shown in FIG. 26(*a*). Next, after the recording material is advanced by a half the distance of the ordinary advance, which corresponds to four ejection orifices (half the number of all ejection orifices), the reversely staggered dot pattern is recorded by the second scanning as shown in FIG. 26(*b*). Lastly, after the recording material is again advanced by the distance which corresponds to the four ejection orifices (half the number of all ejection orifices), the staggered dot pattern is again recorded by the third scanning as shown in FIG. 26(*c*). In other words, the staggered and reversely staggered dot patterns are alternately recorded while the recording material is advanced by the distance correspondent to the four ejection orifices, whereby the recording area correspondent to the four ejection orifices is completed by each scanning. As is evident from the above description, in this system, the same recording area is covered by two different ejection orifices, and therefore, this system can produce high quality images with no recording density irregularity.

In the ink jet recording apparatus shown in FIG. 21 which is the seventh embodiment of the present invention, the ink catcher for catching the ink ejected during the preliminary ejection is provided on both ends of the apparatus, one at the home position HP and the other at a position YP opposite to the home position across the apparatus, which are within the moving range of the carriage 2 and are off the passageway of the recording material 8. In this embodiment, one of the ink catchers (the one on the left in the drawing) is the cap unit 56 itself of the performance recovery unit located at the home position HP, and the other is an ink catching member 58 disposed at the position YP, opposite to the home position. This ink catching member 58 is capable of absorbing and retaining the ink ejected during the preliminary ejection. The ink catching member 58 of this embodiment contains a porous ink absorbing member 59.

The ink absorbing member 59 disposed in the ink catching member 58 is connected to a waste ink absorbing member provided within the main assembly of the apparatus, whereby the ink ejected during the preliminary ejection is led to the waste ink absorbing member, to be stored there. This ink absorbing member 59 may be of an exchangeable type. On the other hand, this ink catching means provided on the side opposite to the home position may be structured so that the ink ejected during the preliminary ejection is sucked out by the recovery pump (unshown) of the performance recovery unit provided on the home position side. In this case, the ink catching member is formed as a cap, and the ink absorbed by the absorbing member 59 and accumulating in it is sucked out by the recovery pump and sent to the waste ink absorbing member.

In the ink jet recording apparatus shown in FIG. 21, the recording is made as the carriage 2 carrying two or more (four in this case) recording heads 1 is moved forward or backward in the primary scanning direction. When a timing for the preliminary ejection arrives during the actual recording operation, the carriage 2 is allowed to move on in the same direction till it reaches the position for preliminary ejection in the same direction, where it faces the ink catching means and ejects the ink into it. In other words, if the preliminary ejection timing arrives while the carriage 2 is moving to the right (scanning forward) in FIG. 21, the carriage 2 is allowed to move to the right end position YP, where it preliminarily ejects the ink into the ink catching means 58 and 59. If the preliminary ejection timing arrives while the carriage 2 is moving to the left (backward scanning) in FIG. 21, the carriage 2 is allowed to move to the home position HP, where it preliminarily ejects the ink into the cap 56, as the ink catching means, of the recovery unit 55.

According to the seventh embodiment described referring to FIG. 21, the ink catching means is provided at both ends of the recording apparatus (two locations), and when the preliminary ejection timing arrives, the carriage 2 is allowed to move in the same direction as it has been moving at the moment to reach the ink catching means, being in the same direction, where the ink is preliminarily ejected. Therefore, the ink is preliminarily ejected with most efficient timing, whereby the ink permeation difference between the recording lines caused by the difference in the elapsed time after the preliminary ejection can be minimized. Thus, the image quality can be improved while increasing the recording speed.

In the eight embodiment of the present invention, the preliminary ejection is carried out each time the scanning direction of the carriage 2 is reversed. In the first sequence of this embodiment, the preliminary ejection is carried out at the same time by four color recording heads 1A to 1D carried on the carriage 2 each time the scanning direction is reversed. In this sequence, the preliminary ejection, scanning reversal, and line feed are carried out with the same timing, whereby the horizontal streaks caused by the difference in the ink permeation time can be effectively prevented. Further, in this sequence, the amount of the ink ejected per preliminary ejection may be smaller, compared to the seventh embodiment.

In the second sequence of the eighth embodiment, one to three recording heads 1 out of four recording heads 1 are made to preliminarily eject the ink at the same time, in other words, one to three colors are preliminarily ejected at the same time, each time the scanning direction is reversed. Since the preliminary ejection is carried out each time the carriage 2 moves out of the recording range, one to three colors out of four colors may be ejected at the same time, and this procedure may be repeated with a predetermined intervals. For example, the black and cyan are preliminarily ejected during the forward scanning, that is, the first scanning, and the magenta and yellow are preliminarily ejected during the backward scanning. Another example is to eject the colors one at a time, that is, to eject the black during the first forward scanning, the cyan during the first backward scanning, the magenta during the second forward scanning, and the yellow during the second backward scanning. This sequence has an advantage of improved recording operation throughput.

When the ink is preliminarily ejected into the ink catching means facing the recording heads (cap 56, ink catching member 58, or the like), the carriage 2 must be moved, with high positional accuracy, to the position where the recording heads is to face the ink catching means. In order to precisely move each of two or more recording heads 1 with reference to a single ink catcher such as the ink catching means (ink catching member) 58 and 59 located at the position YP, a substantial run-up distance is required for the carriage 2. Accordingly, the moving range of the carriage 2 must be extended, whereby it becomes possible for the overall recording time to be prolonged. To correct this disadvantage, each color ink is preliminarily ejected one at a time into one of the two ink catching members located separately at the opposite ends of the moving range of the carriage 2, whereby the moving range of the carriage 2 can be shortened to improve the throughput.

Figure 22:
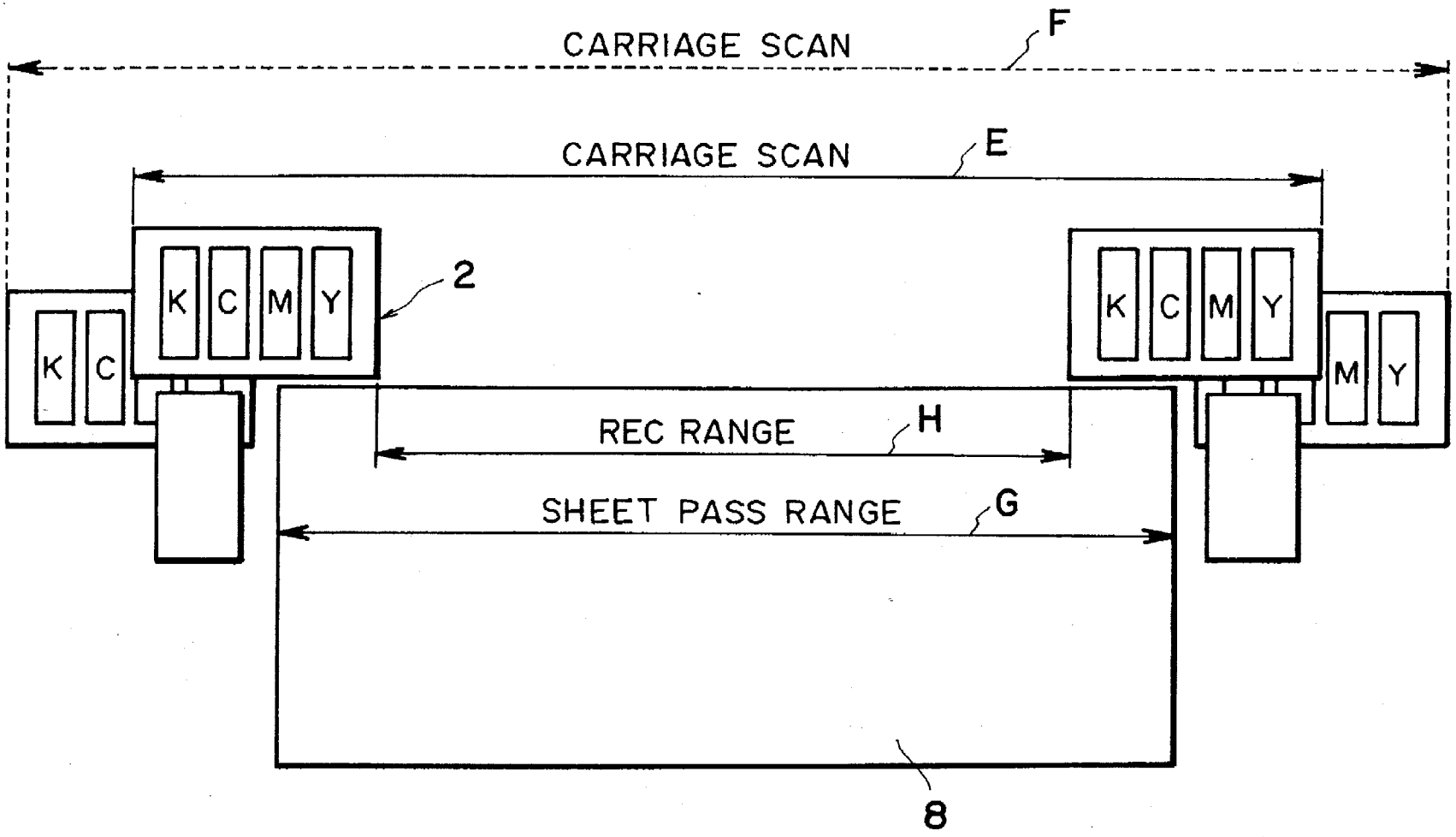
FIG. 22 is a schematic drawing, showing the moving range of the carriage in the ninth embodiment of the present invention.

In the case of recording head arrangement as shown in FIG. 21, the throughput is improved by adopting such a sequence that the recording heads 1A and 1B mounted on the right side of the carriage 2 are made to preliminarily eject the ink at the same time or separately, at the YP position, and the recording heads 1C and 1D mounted on the left side of the carriage 2 are made to preliminarily eject the ink at the same time or separately, at the home position HP. FIG. 22 is a schematic drawing showing the moving range of the carriage 2 in the ink jet recording apparatus which adopts such a sequence (ninth embodiment).

In the ninth embodiment shown in FIG. 22, a range indicated by a solid arrow mark E designates the moving range of the carriage in this embodiment, and a range indicated by a dotted arrow mark F designates the moving range of the carriage when the preliminary ejection is carried out at the same time for all four colors and in both scanning directions. Generally speaking, the sheet passageway range G where the recording material 8 is passed is taken wider than the recording range H of the recording head 1. As is evident from FIG. 22, when the preliminary ejection is carried out during the bidirectional recording operation, the smaller is the number of the recording heads which preliminarily eject the ink at the same time, the shorter the moving range of the carriage 2 can be made, and accordingly, the recording apparatus size can be reduced and the throughtput can be improved.

In the ninth embodiment of the present invention, if the recording apparatus comprises two or more recording heads, and the recording is bidirectionally made, the preliminary ejection of each recording head is separately carried out. In the first sequence of this ninth embodiment, the ink is preliminarily ejected only from the recording heads being not in use for a predetermined period. In this case, the preliminary ejection is carried out by the recording heads having not been in use for the predetermined period, based on the recording data. Therefore, it is possible to avoid unnecessary ink consumption, by adopting this first sequence.

In the second sequence of the eighth embodiment, the preliminary ejection is carried out for the ejection orifices having not been in use for a predetermined period. It is not always that all of the ejection orifices of the recording head 1 are used during the recording operation. Therefore, as the recording operation continues, ejection performance difference occurs between the frequently used ejection orifices and the infrequently used ejection orifices. This phenomenon is thought to be caused by the ink conformability difference between the above described two groups of ejection orifices. For example, when an ejection orifice has not been used for a long recording period, the ink in this ejection orifice increase its viscosity, and increased ink viscosity deteriorates the ink ejection performance. In order to prevent such a phenomenon, the ink is sucked out by the ink ejection performance recovery unit 55. However, in this case, the ink is sucked out even from the ejection orifices which are normally in use during the recording operation. Therefore, as the sucking count increase, the ink consumption increases, in other words, increases wasteful ink consumption.

In order to prevent such a problem as described above, more ink is preliminarily ejected from the infrequently used ejection orifice than the frequently used one, during the recording operation, whereby the performance deterioration of the infrequently used ejection orifice caused by the increased ink viscosity or the like can be prevented. For example, when the ink is ejected at a rate of 300 dots per frequently used ejection orifice during the preliminary ejection, the ink is ejected at a rate of 600 dots per ejection orifice from the infrequently used ejection orifice. By increasing the preliminary ejection count for the infrequently used ejection orifice as described above, the ink ejection performance of the recording head can be sustained at the most excellent level, without increasing the amount of the wasteful ink consumption. As for the discrimination between the frequently used ejection orifice and the infrequently used ejection orifice, it is made by counting the number of recording dots using a recording data buffer, or, if the number of ejection orifices to be used in known based on the types of recording mode (64 orifices are used in a recording mode A; only 48 ejection orifices are used in a recording mode B, and so on), the ejection orifice for which preliminary ejection count is increased is selected based on the aforementioned types of recording mode.

According to the seventh to ninth embodiments, the preliminary ejection catcher is provided at both ends of the recording apparatus, beyond the recording range, and the preliminary ejection is carried out each time the scanning direction of the carriage 2 is reversed during the bidirectional recording operation, whereby it is possible for the preliminary ejection during the recording operation to be carried out as needed outside the recording range each time the scanning direction of the carriage 2 is reversed. Therefore, the throughput of the bidirectional recording can be improved. Further, the recording timing shift caused by the preliminary ejection during the actual recording operation can be eliminated, and therefore, it is possible to prevent the image deterioration such as the horizontal streaks. Lastly, the preliminary ejection count for the infrequently used ejection orifice is increased compared to the frequently used one, and therefore, it is possible to prevent the deterioration of the ink ejection performance while reducing the amount of ink consumption.

While describing each of the embodiments, the description is referred to an exchangeable head cartridge as the recording means in which the recording head member and the ink container are combined. However, the present invention is equally applicable to a recording head comprising an independent recording head member and an independent ink container. In other words, the present invention is applicable regardless of the arrangement between the recording head member and the ink container, with the same effects.

Further, in the embodiments described hereinbefore, the descriptions were referred to a color recording apparatus comprising two or more recording heads for recording in different colors. However, the present invention is equally applicable to a recording apparatus comprising a single recording head, a gradation recording apparatus comprising two or more recording heads for recording in a single color while varying the density, or the like, in other words, the present invention is equally applicable regardless of the number of recording heads or the variety and density of the ink, with the same effects.

The present invention is usable with any ink jet apparatus, such as those using electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to an aspect of the present invention, there is provided an ink jet recording apparatus comprising: a carriage for carrying recording means for effecting recording by ejection of ink on a recording material; a cap for capping an ejection outlet of the recording means formed in an ejection side surface; sucking means for sucking the ink out through the ejection outlet while the cap is closely contacted to the ejection side surface; clearance forming means for forming a clearance at a part of close-contact portion between the ejection side surface and the cap by relative motion between the cap and the carriage.

Therefore, the ink deposited on the ejection side surface of the recording means is removed a much as possible, thus preventing contamination of the inside of the apparatus or the recording material, and preventing deterioration of the wiping means. In addition, the ink ejection of the recording means can be stabilized to permit satisfactory recording operation for long term.

According to another aspect of the present invention, there is provided an ink jet recording apparatus comprising: a carriage for carrying recording means for effecting recording by ejection of ink on a recording material; a cap for capping an ejection outlet of the recording means formed in an ejection side surface; sucking means for sucking the ink out through the ejection outlet while the cap is closely contacted to the ejection side surface: an air communication opening, in the recording means, for communicating a space covered by the cap with an ambient air; and shut-off means for shutting off and opening the air communication opening.

Therefore, the ink can be removed from the ejection side surface of the recording means as much as possible, so that the contamination of the apparatus and the recording material is prevented, thus preventing deterioration of the wiping means. In addition, the ink ejection of the recording means can be stabilized, so that the satisfactory recording operation is possible for a long term.

According to a further aspect of the present invention, there is provided an ink jet recording apparatus in which the ink is ejected on a recording material from recording means moving in a main scan direction, wherein a plurality of recording means are used, and ink receptors are provided at opposite ends outside the recording material passage area, and the ink is ejected to the ink receptor through at least one recording means for each reversal of the main scan movement. Therefore, the reduction of throughput by the preliminary ejection during the recording, can be prevented, and production of lateral stripe due to the deviation of the recording timing can be prevented.

According to a further aspect of the present invention, there is provided a recording unit mountable to a carriage of an ink jet recording apparatus having a cap for capping an ejection outlet of the recording means to effect recording, comprising: an ejection side surface having an ejection outlet; an air communication opening having an end engageable with shut-off means of the ink jet recording apparatus and another end to be covered by the cap.

Therefore, the ink deposited on the ejection side surface of the recording means can be removed as much as possible, thus preventing contamination of the inside of the apparatus and the recording material, and therefore, preventing the deterioration of the performance of the wiping means. Thus, the ink ejection of the recording means is stabilized to permit satisfactory recording operation for a long term.

According to a further aspect of the present invention, there is provided a method of recovering an ink jet apparatus provided with a carriage capable of carrying recording means for effecting recording by ejection of ink on the recording material, comprising the steps of: capping an ejection side surface having an ejection outlet by a cap at least partly deformable; sucking the ink through the ejection outlet by sucking means while the cap being closely contacted to the ejection side surface; forming a clearance at least partly between the cap and the ejection side surface; operating the sucking means while the clearance is present.

Therefore, the ink deposited on the ejection side surface of the recording means is removed as much as possible, thus preventing contamination of the inside of the apparatus and the recording material, thus preventing deterioration of the performance of the wiping means. Thus, the ink ejection of the recording means is stabilized to permit satisfactory recording operation for long term.

According to a yet further aspect of the present invention, there is provided a method of recovering an ink jet recording apparatus having a carriage for carrying recording means for effecting recording by ejection of ink to a recording material, comprising: capping with a cap an ejection outlet formed in an ejection side surface of the recording means; sucking the ink through the ejection outlet while the cap is closely contacted to the ejection side surface, and while an air communication opening provided in the recording means for communication of a space closed by the cap with an ambient air, is being in a closed state; and sucking an inside of the cap while the air communication opening is in an open state.

Therefore, the ink deposited on the ejection side surface of the recording means is removed as much as possible, thus preventing contamination of the inside of the apparatus and the recording material, and preventing deterioration of the performance of the wiping means. The ink ejection of the recording means is stabilized to permit satisfactory recording for the long term.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus comprising:

a carriage for carrying recording means for effecting recording by ejection of ink on a recording material;

a cap for capping an ejection outlet of said recording means formed in an ejection side surface;

sucking means for sucking the ink out through the ejection outlet while said cap is closely contacted to said ejection side surface; and clearance forming means for forming a clearance at a first part of said close-contact portion between said ejection side surface and said cap by relative motion between said cap and said carriage, wherein said clearance forming means maintains a second part of said close-contact portion at a closely contacted state when said clearance is formed.

2. An apparatus according to claim 1, wherein said cap includes an ink absorbing material therein.

3. An apparatus according to claim 1, wherein said clearance forming means moves by a small amount said carriage in a main scan direction.

4. An apparatus according to claim 1, wherein said cap comprises an elastic member deformable movement of said carriage.

5. An ink jet recording apparatus comprising:

a carriage for carrying recording means for effecting recording by ejection of ink on a recording material;

a cap for capping an ejection outlet of said recording means formed in an ejection side surface, wherein the ejection side surface and a contact plane of said cap are inclined at the same angle relative to a main scan direction of said carriage;

sucking means for sucking the ink out through the ejection outlet while said cap is closely contacted to said ejection side surface; and clearance forming means for forming a clearance at a part of close-contact portion between said ejection side surface and said cap by relative motion between said cap and said carriage.

6. An ink jet recording apparatus comprising:

a carriage for carrying recording means for effecting recording by ejection of ink on a recording material;

a cap for capping an ejection outlet of said recording means formed in an ejection side surface, wherein the ejection side surface and a contact plane of said cap are inclined at different angles relative to a main scan direction of said carriage;

sucking means for sucking the ink out through the ejection outlet while said cap is closely contacted to said ejection side surface; and clearance forming means for forming a clearance at a part of close-contact portion between said ejection side surface and said cap by relative motion between said cap and said carriage.

7. An apparatus according to claim 1, wherein said cap is rotatable about an axis parallel to said ejection side surface.

8. An apparatus according to claim 1, wherein said recording means has an electrothermal transducer for producing thermal energy for ejecting the ink.

9. An apparatus according to claim 1, wherein said recording means ejects the ink through the ejection outlet by film boiling produced in the ink by thermal energy provided by an electrothermal transducer.

10. An ink jet recording apparatus comprising:

a carriage for carrying recording means for effecting recording by ejection of ink on a recording material;

a cap for capping an ejection outlet of said recording means formed in an ejection side surface;

sucking means for sucking the ink out through the ejection outlet while said cap is closely contacted to said ejection side surface;

an air communication opening, in said recording means, for communicating a space covered by said cap with ambient air, wherein said air communication opening is open at one end in said ejection side surface; and shut-off means for shutting off and opening said air communication opening.

11. An apparatus according to claim 10, wherein said cap includes an ink absorbing material therein.

12. An apparatus according to claim 10, wherein a plurality of such air communication openings are provided in said recording means.

13. An apparatus according to claim 10, wherein said ink jet recording apparatus comprises a plurality of such recording means each provided with said air communication opening.

14. An apparatus according to claim 10, wherein said recording means has an electrothermal transducer for producing thermal energy for ejecting the ink.

15. An apparatus according to claim 10, wherein said recording means ejects the ink through the ejection outlet by film boiling produced in the ink by thermal energy provided by an electrothermal transducer.

16. A recording unit mountable to a carriage of an ink jet recording apparatus having a cap for capping an ejection outlet of said recording unit to effect recording, comprising:

an ejection side surface having an ejection outlet; and an air communication opening having an end engageable with shut-off means for sealing said air communication opening of said ink jet recording apparatus and another end to be covered by the cap, wherein said air communication opening is open at one end in said ejection side surface.

17. A recording unit according to claim 16, wherein a plurality of such air communication openings are provided in said recording unit.

18. A recording unit according to claim 16, wherein said recording unit has an electrothermal transducer for producing thermal energy for ejecting the ink.

19. A recording unit according to claim 16, wherein said recording unit ejects the ink through the ejection outlet by film boiling produced in the ink by thermal energy provided by an electrothermal transducer.

20. A method of recovering an ink jet apparatus provided with a carriage capable of carrying recording means for effecting recording by ejection of ink on the recording material, comprising the steps of:

capping an ejection side surface having an ejection outlet by a cap at least partly deformable;

sucking the ink through the ejection outlet by sucking means while the cap being closely contacted to the ejection side surface;

forming a clearance at a first part of the close-contact portion between the cap and the ejection side surface while maintaining a second part of the close-contact portion at a closely contacted state; and operating said sucking means while the clearance is present.

21. A method according to claim 20, wherein before the cap is moved away from said ejection side surface, a cap having an ink absorbing material therein is closely contacted to the ejection side surface.

22. A method of recovering an ink jet recording apparatus having a carriage for carrying recording means for effecting recording by ejection of ink to a recording material, comprising:

capping with a cap an ejection outlet formed in an ejection side surface of said recording means;

sucking the ink through said ejection outlet while the cap is closely contacted to the ejection side surface, and while an air communication opening provided in said recording means for communication of a space closed by the cap with ambient air, is being in a closed state, wherein said air communication opening is open at one end in said ejection side surface; and sucking an inside of the cap while the air communication opening is in an open state.

23. A method according to claim 22, wherein before the cap is moved away from said ejection side surface, a cap having an ink absorbing material therein is closely contacted to the ejection side surface.

* * * * *

UNITED STATES PATENT AND TRADEMARK OFFICE

CERTIFICATE OF CORRECTION

PATENT NO. : 5,670,997

DATED : September 23, 1997

INVENTOR(S): HITOSHI SUGIMOTO ET AL.

It is certified that error appears in the above-identified patent and that said Letters Patent is hereby corrected as shown below:

ON TITLE PAGE AT [56], U.S. PATENT DOCUMENTS

"Tommii et al." should read --Tomii et al--.

COLUMN 1

Line 34, "transverses" should read --traverses--;
Line 35, "lane" should read --line--.

COLUMN 3

Line 19, "an" should read --a--.

COLUMN 4

Line 9, "An" should read --a--.
Line 17, "such" should read --suck--;
Line 20, "in" should read --In--;
Line 23, "conditions." should read --points of constriction.--;
Line 42, "ate" should read --as--;
Line 52, "ejectoin" should read --ejection--;
Line 63, "(don" should read --(do--.

UNITED STATES PATENT AND TRADEMARK OFFICE

CERTIFICATE OF CORRECTION

PATENT NO. : 5,670,997

DATED : September 23, 1997

INVENTOR(S): HITOSHI SUGIMOTO ET AL.

It is certified that error appears in the above-identified patent and that said Letters Patent is hereby corrected as shown below:

COLUMN 8

Line 14, "is" should read --are--;
Line 18, "is" should read --are--;
Line 21, "is" should read --are--;
Line 24, "is" should read --are--;
Line 27, "is" should read --are--;
Line 30, "is" should read --are--;
Line 34, "is" should read --are--;
Line 37, "is" should read --are--.

COLUMN 9

Line 40, "place" should read --placed--.

COLUMN 11

Line 26, "steak" (both occurrences) should read --streak--;
Line 55, "Mount" should read --amount--;
Line 67, "phenomenons" should read --phenomena--.

COLUMN 12

Line 54, "places" should read --placed--;
Line 67, "give" should read --given--.

UNITED STATES PATENT AND TRADEMARK OFFICE

CERTIFICATE OF CORRECTION

PATENT NO. : 5,670,997

DATED : September 23, 1997

INVENTOR(S): HITOSHI SUGIMOTO ET AL.

It is certified that error appears in the above-identified patent and that said Letters Patent is hereby corrected as shown below:

COLUMN 14

Line 22, "gibes" should read --gives--;
Line 53, "sever" should read --severe--.

COLUMN 15

Line 21, "teams" should read --terms--.

COLUMN 16

Line 2, "had" should read --and--.

COLUMN 17

Line 27, "than in the original version" should be deleted.

COLUMN 18

Line 30, "height" should read --high--;
Line 52, "show" should read --shows--;
Line 55, "soon" should read --seen--.

COLUMN 19

Line 11, "embodiments" should read --embodiment--.

UNITED STATES PATENT AND TRADEMARK OFFICE

CERTIFICATE OF CORRECTION

PATENT NO. : 5,670,997

DATED : September 23, 1997

INVENTOR(S): HITOSHI SUGIMOTO ET AL.

It is certified that error appears in the above-identified patent and that said Letters Patent is hereby corrected as shown below:

COLUMN 20

Line 41, "no" should read --not--;
Line 64, "sever" should read --severe--.

COLUMN 21

Line 14, "head" should read --heads--;
Line 16, "head" should read --heads--.

COLUMN 22

Line 5, "he" should read --the--.

COLUMN 23

Line 35, "date" should read --data--;
Line 51, "and" should read --an--.

UNITED STATES PATENT AND TRADEMARK OFFICE

CERTIFICATE OF CORRECTION

PATENT NO. : 5,670,997

DATED : September 23, 1997

INVENTOR(S): HITOSHI SUGIMOTO ET AL.

It is certified that error appears in the above-identified patent and that said Letters Patent is hereby corrected as shown below:

COLUMN 24

Line 24, "idealistic" (both occurrences) should read --ideal--.

COLUMN 26

Line 46, "eight" should read --eighth--.

COLUMN 28

Line 16, "increase," should read --increases,--.

Signed and Sealed this

Seventh Day of July, 1998

Bruce Lehman

*Attest:*

BRUCE LEHMAN

*Attesting Officer*

*Commissioner of Patents and Trademarks*